US007781139B2

(12) United States Patent
Ariyoshi et al.

(10) Patent No.: US 7,781,139 B2
(45) Date of Patent: Aug. 24, 2010

(54) TONER MANUFACTURING METHOD

(75) Inventors: Satoru Ariyoshi, Nara (JP); Yoshitaka Kawase, Nara (JP); Keiichi Kikawa, Osaka (JP); Katsuru Matsumoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 896 days.

(21) Appl. No.: 11/607,929

(22) Filed: Dec. 4, 2006

(65) Prior Publication Data

US 2007/0128537 A1 Jun. 7, 2007

(30) Foreign Application Priority Data

Dec. 2, 2005 (JP) ..... P2005-349496

(51) Int. Cl.
*G03G 9/08* (2006.01)

(52) U.S. Cl. ..... 430/137.19

(58) Field of Classification Search ..... 430/137.18, 430/137.19

See application file for complete search history.

(56) References Cited

U.S. PATENT DOCUMENTS

| | | | | |
|---|---|---|---|---|
| 6,677,097 | B2 * | 1/2004 | Ohmura et al. | 430/110.3 |
| 6,821,703 | B2 | 11/2004 | Uno et al. | |
| 2003/0027066 | A1 | 2/2003 | Yamashita et al. | |
| 2004/0081907 | A1 | 4/2004 | Akazawa et al. | |
| 2006/0115759 | A1 | 6/2006 | Kim et al. | |
| 2007/0202433 | A1 | 8/2007 | Matsumoto et al. | |

FOREIGN PATENT DOCUMENTS

| | | | |
|---|---|---|---|
| JP | 62-127750 | A | 6/1987 |
| JP | 62-127751 | A | 6/1987 |
| JP | 62-127752 | A | 6/1987 |
| JP | 2-32363 | | 2/1990 |
| JP | 3-220203 | | 9/1991 |
| JP | 5-181315 | A | 7/1993 |
| JP | 8-305084 | | 11/1996 |
| JP | 9-311502 | | 12/1997 |
| JP | 10-312086 | | 11/1998 |
| JP | 2000-292973 | A | 10/2000 |

(Continued)

OTHER PUBLICATIONS

Japanese Patent Office machine-assisted translation of JP 2006-235030 (pub. Sep. 2006).*

(Continued)

*Primary Examiner*—Janis L Dote
(74) *Attorney, Agent, or Firm*—Nixon & Vanderhye P.C.

(57) ABSTRACT

A toner manufacturing method that allows production of toner having desired characteristics with stability in accordance with fusion emulsification technique for obtaining a toner by granulating a resin kneaded product while dispersing it in an aqueous medium. A resin kneaded product containing at least a binder resin and a colorant is mixed with a dispersant/water-containing aqueous medium. The resultant admixture is stirred by an stirring apparatus including a screen with an admixture discharge hole disposed internally of a vessel and a rotor disposed in an stirring space created by the screen.

9 Claims, 3 Drawing Sheets

FOREIGN PATENT DOCUMENTS

| | | | | |
|---|---|---|---|---|
| JP | 2002-72562 | | | 3/2002 |
| JP | 2002-221824 | A | | 8/2002 |
| JP | 2002-292330 | A | | 10/2002 |
| JP | 2002-296839 | | | 10/2002 |
| JP | 2002-351140 | | | 12/2002 |
| JP | 2004-008898 | | | 1/2004 |
| JP | 2005-36076 | A | | 2/2005 |
| JP | 2005-165039 | | | 6/2005 |
| JP | 2005-258334 | | * | 9/2005 |
| JP | 2005-301061 | | | 10/2005 |
| JP | 2006-235030 | | * | 9/2006 |

OTHER PUBLICATIONS

Japanese Patent Office machine-assisted translation of JP 2005-258334 (pub. Sep. 2005).*

Neufeldt, V., et al., ed., Webster's New World Dictionary, Third College Edition, Simon & Schuster, Inc., NY (1988), p. 1234.*

Translation JP 2004-008898 (published Jan. 2004)—Machine translation.

Patent Abstracts of Japan, Watanabe Hideki et al, 2002-040713, published Feb. 6, 2002, "Approximately Spherical Toner and Producing Method Thereof".

* cited by examiner

TONER MANUFACTURING METHOD

CROSS-REFERENCE TO RELATED APPLICATION

This application claims priority to Japanese Patent Application No. JP 2005-349496, which was filed on Dec. 2, 2005, the contents of which, are incorporated herein by reference, in their entirety.

BACKGROUND OF THE INVENTION

1. Field of the Invention

The present invention relates to a method for manufacturing a toner designed for use in development of an electrostatic charge image or the like during the course of image formation effected by means of electrophotography or otherwise.

2. Description of the Related Art

In an electrophotographic image forming apparatus for forming images by electrophotographic method, image formation is accomplished in the following manner, for example. After an electrostatic charge image is formed on a surface of an electrophotographic photoreceptor (hereafter also referred to simply as "the photoreceptor") by various apparatuses, the electrostatic charge image is developed into a toner image by using a supplied toner. Lastly, the toner image is transferred onto a transference material such as a paper sheet and is then fixed into place. The toner used to develop the electrostatic charge image (here after referred to as "the electrostatic charge image developing toner") is composed of a binder resin having dispersed therein additives such as a colorant and a charge controlling agent. The toner is electrically charged by friction and is then carried on a developing roller or the like means whereby to supply the toner to the surface of the photoreceptor.

In recent years, as research and development have been carried out to design toners having increasingly smaller particle size with the objective of attaining upgraded image quality, such a toner as has a small volumetric average particle diameter ranging, for example, approximately from 3 μm to 8 μm has been coming into wider and wider use. For toner production, a so-called pulverization method has been widely used; that is, a method of obtaining a toner by kneading a binder resin, a colorant, and other additive as required, and then dry-pulverizing the resultant resin kneaded product. In the case of adopting the pulverization method, however, the smaller is the particle diameter of the toner obtained, the more likely it is that the particles will be irregular-shaped. This gives rise to a problem of a significant deterioration in powder fluidity. Such a toner as has poor powder fluidity cannot be supplied to the surface of the photoreceptor with stability in a development process, in consequence whereof there results degradation in image quality.

Moreover, the toner obtained by the pulverization method is liable to suffer from uneven charging capability because of its relatively wide range of particle size distribution. If image formation is carried out by using such a toner as has uneven charging capability, at the time of transferring a toner image onto a transference material, part of the toner cannot be transferred onto the transference material properly due to lack of charge amounts, thus causing an undesirable decrease in image density or the like problem. Occurrence of uneven charging capability in the toner obtained by the pulverization method cannot be prevented without the necessity of carrying out classification after granulation is completed through a pulverization process to narrow the particle size distribution range. However, the classification leads to low toner yield and thus gives rise to another problem of high cost of manufacturing.

As described hereinabove, the pulverization method presents various problems. Therefore, as an alternative, the adoption of a wet method has been examined for toner production. For example, the wet methods include:

(i) a suspension polymerization method for obtaining a toner by polymerizing, in the presence of a colorant, monomer of a binder resin dispersed in water by using a suspension stabilizer, and encapsulating the colorant in binder resin particles to be formed (refer to Japanese Unexamined Patent Publication JP-A 8-305084 (1996) (pages 4 and 5, FIGS. 1 and 2) and Japanese Examined Patent Publication JP-B2 3466872(pages 3 to 5, FIGS. 1 and 2), for example);

(ii) an emulsification polymerization-based agglomeration method for obtaining a toner by mixing a water dispersion of resin particles obtained through emulsification polymerization of binder resin monomer and a water dispersion of a colorant or the like to form agglomerated particles of the resin and the colorant, and melting the agglomerated particles with application of heat;

(iii) a phase inversion emulsification method for obtaining a toner by dissolving or dispersing water-dispersible resin and a colorant in an organic solvent, adding thereto water and a neutralization agent for neutralizing a dissociation group of the water-dispersible resin with stirring to form resin solution droplets having enclosed therein the colorant and the like, and subjecting the resin solution droplets to phase inversion emulsification;

(iv) a dissolution suspension method for obtaining a toner by dissolving or dispersing a toner material containing a binder resin and a colorant in an organic solvent in which the binder resin is soluble, mixing the obtained solution or dispersion with a water dispersion of an inorganic dispersant, for example a less water-soluble alkaline earth metal salt such as calcium phosphate or calcium carbonate to achieve granulation, and removing the organic solvent; and (v) an emulsification dispersion method for obtaining a toner by dissolving or dispersing a binder resin, a colorant, and the like in a water-insoluble organic solvent in which the binder resin is soluble, emulsifying and dispersing the obtained solution or dispersion in an aqueous dispersion, and removing the organic solvent.

However, the above stated methods (i) through (v) present the following problems. For example, according to the polymerization method such as the suspension polymerization method (i) and the emulsification polymerization-based agglomeration method (ii), a polymerization reaction takes place in water. Therefore, a resin material which is usable as a binder resin is limited to vinyl polymer that can be produced by radical polymerization. In consideration of toner fixation property and toner transparency which is required to form a color toner, it is desirable to use polyester resin rather than vinyl polymer as the binder resin. That is, it is preferable that the binder resin is selected properly in accordance with desired characteristics to be fulfilled by a toner to be produced. Accordingly, a toner manufacturing method is sought after that does not necessarily have to use vinyl polymer but can use resin materials of various type.

Another problem associated with the polymerization method is occurrence of uneven charging capability in toner particles resulting from residual binder resin monomer, polymerization initiator, and suspension stabilizer, and so forth remaining within the toner particles. Although occurrence of uneven charging capability cannot be prevented without the necessity of removing such residues, it is extremely difficult to remove the monomer, polymerization initiator, and suspension stabilizer, and so forth incorporated inside the toner particles. Moreover, according to the emulsification polymerization-based agglomeration method (ii), since a toner is produced by melting the agglomerated particles of the binder resin, the colorant, and so forth with application of heat, there arises a problem that toner particles having uniform composition cannot be formed with stability.

Further, according to the phase inversion emulsification method (iii), the dissolution suspension method (iv), and the emulsification dispersion method (v), since an organic solvent is used to dissolve or disperse the binder resin, a solvent collecting apparatus is required in view of an attitude toward environmental issues. This necessitates a large-scale manufacturing facility. Another problem associated with the methods (iii) through (v) is that a resin material which is usable as the binder resin is limited to a water-dispersible resin having a dissociation group or an organic solvent-soluble resin.

As a technique to solve these problems, a so-called fusion emulsification method has been proposed to date (refer to Japanese Unexamined Patent Publication JP-A 2005-165039 (pages 4, 8, and 9), for example). This is a method of obtaining a toner by melting and kneading constituents for toner such as a binder resin and a colorant, mixing the obtained resin kneaded product with an aqueous medium containing a dispersant, and stirring the resultant admixture while applying heat to the aqueous medium contained in the admixture to disperse and granulate the resin kneaded product. According to the fusion emulsification method, it is possible to use resin materials of various type as the binder resin, and thereby allow easy production of a toner having desired characteristics.

As described hereinabove, according to the fusion emulsification method disclosed in JP-A 2005-165039 for example, it is possible to produce a toner having desired characteristics by using resin materials of various type as a binder resin. However, from the standpoint of obtaining a toner having desired characteristics more reliably, further improvement is hoped for in the technique disclosed in JP-A 2005-165039.

According to the fusion emulsification method, heat is applied to the aqueous medium contained in the admixture of the resin kneaded product and the aqueous medium to soften the resin kneaded product. After that, the softened resin kneaded product is pulverized and dispersed by an stirring apparatus, and is thereby granulated. At this time, depending upon a temperature at which the aqueous medium is heated, the melt viscosity of the resin kneaded product may become so low that various components contained in the resin kneaded product, such as a colorant, a release agent, and a charge controlling agent are liable to agglomerate. This could lead to low dispersibility. Moreover, the components dispersed in the resin kneaded product such as the colorant may be separated from the resin kneaded product, which could result in deviation of the composition of a toner to be obtained from the intended composition. Variation in the dispersibility or composition of the components contained in the resin kneaded product gives rise to a problem that the desired characteristics cannot be attained. Accordingly, from the stand point of obtaining a toner having the desired characteristics, it is preferable to adjust the temperature at which the aqueous medium is heated to be as low as possible. However, the lower is the heating temperature for the aqueous medium, the more likely it is that the resin kneaded product will not be melted easily. This increases the possibility of a failure of granulation. Furthermore, even if granulation can be achieved somehow or other, it is difficult to obtain a volumetric average particle diameter ranging from approximately 3 μm to 8 μm, which is suitable for an electrostatic charge image developing toner, and also it is inevitable that the particle size distribution becomes broad.

JP-A 8-305084 and JP-B2 3466872 described previously made the following proposal to attain improved granulation capability. That is, a polymeric monomer constituent containing a polymeric monomer, a colorant, and a polymerization initiator is granulated in an aqueous disperse medium under a shear force, for example, exerted by a rotor and a screen surrounding it. After that, the resultant particles are polymerized by means of suspension polymerization. However, the techniques disclosed in JP-A 8-305084 and JP-B2 3466872 relate only to the suspension polymerization method, and pays no regard to the fusion emulsification method. Accordingly, the techniques disclosed in JP-A 8-305084 and JP-B2 3466872 cannot be applied as they are to the fusion emulsification method.

SUMMARY OF THE INVENTION

An object of the invention is to provide a toner manufacturing method that allows production of a toner having desired characteristics with stability in accordance with a fusion emulsification technique for obtaining a toner by granulating a resin kneaded product while dispersing it in an aqueous medium.

The invention provides a toner manufacturing method comprising:

a kneading step of kneading at least a binder resin and a colorant;

a granulation step of mixing a resin kneaded product obtained through the kneading step with an aqueous medium containing a dispersant and water, and heating the aqueous medium contained in an obtained admixture to a predetermined temperature while stirring the admixture so as to form resin particles containing the colorant within the aqueous medium; and a separation step of separating the formed resin particles containing the colorant from the aqueous medium, wherein, in the granulation step, the admixture is stirred by an stirring apparatus comprising a vessel for housing therein the admixture; an stirring space forming member for partitioning a space within the vessel into an stirring space in which the admixture is stirred and a space outside the stirring space, the stirring space forming member having an admixture discharge hole for providing communication between the stirring space and the space outside the stirring space; and an stirring section for stirring the admixture accommodated in the stirring space.

According to the invention, a toner is produced through the kneading step, the granulation step, and the separation step. In the kneading step, at least a binder resin and a colorant are kneaded together to prepare a resin kneaded product. In the granulation step, the resin kneaded product obtained through the kneading step is mixed with an aqueous medium containing a dispersant and water (hereafter also referred to as "a dispersant-containing aqueous medium"). After that, the aqueous medium contained in the obtained admixture is heated to a predetermined temperature and simultaneously the admixture is stirred in a specific stirring apparatus. In this way, resin particles containing the colorant are formed in the aqueous medium. In the separation step, the resin particles containing the colorant formed in the granulation step are separated from the aqueous medium. Herein, the sentence "the aqueous medium is heated to a predetermined temperature" means at least that heat is applied to increase the temperature of the aqueous medium to the predetermined temperature, and, in a broad sense, means that, in a case where the temperature of the aqueous medium contained in the admixture is equal to the predetermined temperature, heat is applied lest the temperature of the aqueous medium should be lower than the predetermined temperature.

The stirring apparatus used for stirring in the granulation step includes the vessel, the stirring space forming member, and the stirring section. The admixture of the resin kneaded product and the dispersant-containing aqueous medium is housed in the vessel. The admixture is stirred by the stirring section in the stirring space created by partitioning the space within the vessel by the stirring space forming member. The stirring space forming member is provided with the admixture discharge hole for providing communication between the stirring space and the space outside the stirring space within the vessel. Therefore, as the admixture accommodated in the stirring space is stirred by the stirring section, the admixture can be discharged through the admixture discharge hole into the space outside the stirring space within the vessel on an intermittent basis. At this time, a shear force can be developed between the admixture portion being discharged through the admixture discharge hole and the admixture portion remaining in the stirring space. In addition, a collision force can be developed between the admixture portion having been discharged through the admixture discharge hole and the admixture portion accommodated in the space outside the stirring space. In this case, by properly selecting operating conditions for the stirring apparatus and conditions to be fulfilled by the dispersant for use, it is possible to pulverize the resin kneaded product contained in the admixture with ease, and thereby keep the temperature set for the aqueous medium, namely the temperature at which the aqueous medium is heated in the granulation step (hereafter also referred to as "the granulation temperature") at a lower level without deteriorating the granulability of the resin kneaded product. Accordingly, in the granulation step, it is possible to prevent the component such as the colorant contained in the resin kneaded product from changing in its dispersibility and composition, and thereby produce a toner having desired characteristics with stability.

Herein, the term "the resin particles containing the colorant" refers to resin particles containing at least a colorant. Specifically, in a case where, in the kneading step, the resin kneaded product is prepared by kneading the binder resin and the colorant, and also additives such as a charge controlling agent and a release agent, the resultant resin particles contain these additives in addition to the colorant. This is also defined as "the resin particles containing the colorant". Moreover, the term "toner" refers, so long as no external additive agent such as a surface reforming agent is externally added to the resin particles containing the colorant (hereafter also referred to as "toner particles") produced in the granulation step, to the toner particles in itself, but also refers, in a case where an external additive agent such as a surface reforming agent is externally added to the toner particles, to the resultant composite containing the toner particles and the external additive agent.

In the invention, it is preferable that the admixture discharge hole of the stirring space forming member is formed in a shape of a slit.

According to the invention, the admixture discharge hole of the stirring space forming member is formed in the shape of a slit. In this case, such resin particles containing the colorant as have a small volumetric average particle diameter ranging, for example, from 3 μm to 8 μm can be formed with ease. As another advantage, since the admixture existing in the stirring space can be discharged through the admixture discharge hole with stability, it is possible to achieve the granulation of the resin kneaded product more efficiently.

In the invention, it is preferable that the stirring section includes a rotary shaft member which is rotatable about its axis of rotation, and a blade member which is formed on an outer peripheral surface of the rotary shaft member so as to extend radially outwardly of the rotary shaft member.

According to the invention, in the stirring section, the admixture accommodated in the stirring space is stirred by the blade member disposed on the outer peripheral surface of the rotary shaft member which is rotatable about its axis of rotation. By the action of the stirring section, the admixture in the stirring space can be stirred evenly and then discharged into the space outside the stirring space one after another. This makes it possible to suppress the widening of the particle size distribution of the resin particles containing the colorant, and thereby obtain a toner free from, for example, uneven charging capability that is thus suitable for use as an electrostatic charge image developing toner.

In the invention, it is preferable that rotational circumferential velocity of the blade member is greater than 3.7 m/s and equal to or less than 40 m/s.

According to the invention, the rotational circumferential velocity of the blade member is greater than 3.7 m/s and equal to or less than 40 m/s. Herein, the term "the rotational circumferential velocity of the blade member" refers to "the value obtained by calculation on the basis of the maximum outer diameter of the blade member". So long as the rotational circumferential velocity of the blade member is greater than 3.7 m/s and equal to or less than 40 m/s, the shear force and the collision force developed at the time when the admixture is discharged through the admixture discharge hole can be kept at an appropriate level for the granulation of the resin kneaded product. Accordingly, the granulation of the resin kneaded product contained in the admixture can be achieved more reliably.

In the invention, it is preferable that the stirring space forming member is rotated about the axis of rotation which is substantially in parallel with the axis of rotation of the rotary shaft member of the stirring section in a direction reverse to the direction in which the rotary shaft member is rotated.

According to the invention, the stirring space forming member is rotated about the axis of rotation which is substantially in parallel with the axis of rotation of the rotary shaft member of the stirring section in a direction reverse to the direction in which the rotary shaft member is rotated. In this case, since the stirring space forming member and the blade member of the stirring section can be rotated in opposite directions, it follows that the flow of the admixture to be discharged from the admixture discharge hole of the stirring space forming member is blocked more frequently in the stirring space forming member exclusive of the area in which the admixture discharge hole is formed, namely the admixture discharge hole region. This makes it possible to impart greater shear force and collision force to the admixture, and thereby achieve the granulation of the resin kneaded product more efficiently. Accordingly, such resin particles containing the colorant as have a small volumetric average particle diameter ranging, for example, from 3 μm to 8 μm can be formed more easily.

In the invention, it is preferable that a ratio of the number of rotations of the stirring space forming member to the number of rotations of the rotary shaft member (the number of rotations of the stirring space forming member/the number of rotations of the rotary shaft member) falls in a range of from 0.50 to 0.95.

According to the invention, the ratio of the number of rotations of the stirring space forming member to the number of rotations of the rotary shaft member (the number of rotations of the stirring space forming member/the number of rotations of the rotary shaft member) is set to fall in a range of from 0.50 to 0.95. This makes it possible to control the frequency with which the flow of the admixture to be discharged from the discharge hole is blocked in such a way as to impart shear force and collision force ideal for the granulation of the resin kneaded product to the admixture, and thereby form such resin particles containing the colorant as have a small volumetric average particle diameter ranging, for example, from 3 μm to 8 μm more easily.

In the invention, it is preferable that a temperature set for the aqueous medium in the granulation step stands at or above a value obtained by subtracting 20 (° C.) from the softening temperature Tm (° C.) of the resin kneaded product contained in the admixture (Tm−20[° C.]).

According to the invention, in the granulation step, the aqueous medium is heated to a temperature standing at or above the value obtained by subtracting 20 (° C.) from the softening temperature Tm (° C.) of the resin kneaded product contained in the admixture (Tm−20 [° C.]). This makes it possible to bring the resin kneaded product into a softened state suitable for granulation, and thereby achieve the granulation of the resin kneaded product more reliably.

In the invention, it is preferable that a loss elastic modulus G" of the resin kneaded product is kept at or below $10^5$ Pa at the temperature set for the aqueous medium in the granulation step.

According to the invention, the loss elastic modulus G" of the resin kneaded product is kept at or below $10^5$ Pa at the temperature set for the aqueous medium in the granulation step. This makes it possible to achieve the granulation of the resin kneaded product more easily.

In the invention, it is preferable that the dispersant for use is a substance soluble in water.

According to the invention, the dispersant contained in the dispersant-containing aqueous medium is made of a substance which is soluble in water. Therefore, the dispersant is contained in a water-dissolved state in the admixture of the resin kneaded product and the dispersant-containing aqueous medium. In this case, in contrast to the case where the dispersant is contained in a solid state in the admixture, it is possible to prevent generation of air bubbles from the dispersant, and thereby achieve efficient granulation of the resin kneaded product. As another advantage, since the dispersant can be prevented from remaining in the resultant toner particles, it is possible to obtain with ease a toner free from, for example, uneven charging capability and thus lack of uniformity in its characteristics.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
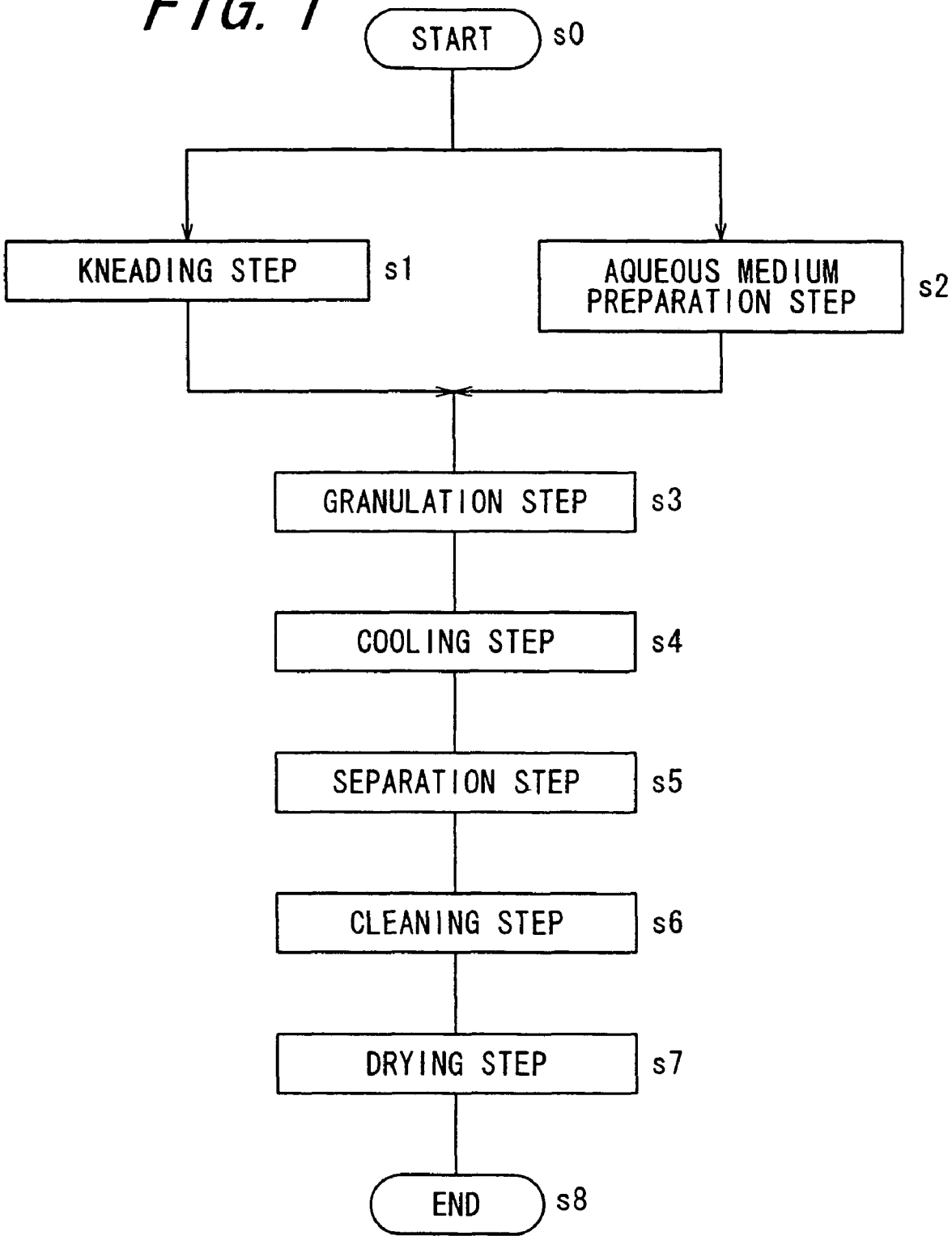
FIG. 1 is a flowchart showing a toner manufacturing method according to an embodiment of the invention.

Now referring to the drawings, preferred embodiments of the invention are described below.

FIG. 1 is a flowchart showing a toner manufacturing method according to an embodiment of the invention. The toner manufacturing method of the invention comprises at least a kneading step, a granulation step, and a separation step. In the present embodiment, the toner manufacturing method further includes an aqueous medium preparation step, a cooling step, a cleaning step, and a drying step. That is, according to this embodiment, the toner manufacturing method comprises the kneading step (Step s1), the aqueous medium preparation step (Step s2), the granulation step (Step s3), the cooling step (Step s4), the separation step (Step s5), the cleaning step (Step s6), and the drying step (Step s7). The toner manufacturing method of the embodiment starts a sequence of steps from Step s0, and the procedure proceeds to Step s1 or step s2. Note that either of the kneading step at Step s1 and the aqueous medium preparation step at Step s2 may precede the other, and that the cleaning step at Step s6 may follow the cooling step at Step s4 and precede the separation step at Step s5.

[Kneading Step]

In the kneading step at Step s1, constituents for toner including at least a binder resin and a colorant are melt-kneaded to obtain a resin kneaded product. The constituents for toner may include additives such as a charge controlling agent and a release agent. These additives are kneaded together with the binder resin and the colorant so as to be dispersed in the resultant resin kneaded product.

(a) Binder Resin

There is no particular limitation to a binder resin to be used so long as it is fusible through application of heat.

Although a softening temperature of the binder resin is not specifically limited and can therefore be selected in a wide range, preferably it is set at or below 150° C. More preferably, the softening temperature of the binder resin falls within a range of from 60° C. to 150° C. If the softening temperature is greater than 150° C., the binder resin cannot be kneaded thoroughly with the colorant and other additive, which could lead to deterioration in the dispersibility of the colorant and other additive. Furthermore, the resultant toner may exhibit poor fixability with respect to a transference material that will eventually cause improper fixation. By contrast, if the softening temperature of the binder resin is less than 60° C., a glass transition temperature (Tg) of the binder resin is liable to be close to room temperature. In this case, thermal aggregation of toner may occur inside an image forming apparatus, which results in the possibility of improper printing, apparatus malfunction, or other problems.

Although the glass transition temperature (Tg) of the binder resin is not specifically limited and can therefore be selected in a wide range, preferably it is adjusted to fall in a range of from 30° C. to 80° C. in consideration of the fixability, the storage stability, and so forth of the toner to be obtained. If the glass transition temperature (Tg) of the binder resin is less than 30° C., the storage stability may become insufficient, and thus thermal aggregation of toner tends to occur inside the image forming apparatus. This could lead to occurrence of improper printing. There is also the possibility of causing a hot-offset phenomenon. By contrast, if the glass transition temperature (Tg) of the binder resin is greater than 80° C., the fixability may be lowered, which could lead to a failure of proper fixation.

Although a molecular weight of the binder resin is not specifically limited and it can therefore be selected in a wide range, preferably it is adjusted to fall in a range of from 5000 to 500000 in terms of weight average molecular weight. If the weight average molecular weight of the binder resin is less than 5000, its mechanical strength may fall short of the necessary level of mechanical strength to be fulfilled by a toner-forming binder resin. In this case, the resultant toner particles are pulverized through stirring or otherwise within a developing apparatus and eventually change their shapes. This could lead to uneven charging capability. By contrast, if the weight average molecular weight of the binder resin is greater than 500000, the binder resin cannot be kneaded thoroughly with the colorant and other additive, which could lead to deterioration in the dispersibility of the colorant and other additive. Furthermore, the glass transition temperature (Tg) of the binder resin is liable to exceed 80° C., which could lead to poor fixability and thus a failure of proper fixation. Note that the weight average molecular weight of the binder resin takes on a value obtained by measurement in accordance with gel permeation chromatography (GPC for short) on a polystyrene basis.

Specific examples of the binder resin include polyester resin, polyurethane resin, epoxy resin, and acrylic resin. Among them, the use of polyester resin is particularly desirable in view of powder flowability, low-temperature fixing property, and other characteristics to be imparted to the resultant toner particles. As another advantage, polyester resin is excellent in transparency and thus lends itself to formation of a color toner having excellent secondary color reproducibility. That is, polyester resin is suitable as a binder resin for use in color toner formation.

There is no particular limitation to polyester resin for use and therefore publicly known ones can be used. For example, there is known a compound of polybasic acids and polyhydric alcohols obtained by condensation polymerization. Herein, polybasic acids refer to a polybasic acid and its derivatives, for example polybasic acid anhydrides or esterified compounds. Moreover, polyhydric alcohols refer to compounds having two or more hydroxyl groups, for example both alcohols and phenols.

As polybasic acids, those used customarily as monomer of polyester resin can be used. The examples thereof include: aromatic carboxylic acids such as a terephthalic acid, an isophthalic acid, a phthalic acid anhydride, a trimellitic acid anhydride, a pyromellitic acid, and a naphthalene dicarboxylic acid; and aliphatic carboxylic acids such as a maleic acid anhydride, a fumaric acid, a succinic acid, and an adipic acid. These polybasic acids may be used each alone or two or more kinds of them may be used in combination.

As polyhydric alcohols, those used customarily as monomer of polyester resin can also be used. The examples thereof include: aliphatic polyhydric alcohols such as ethyleneglycol, propylene glycol, butane diol, hexane diol, neopentyl glycol, and glycerin; alicyclic polyhydric alcohols such as cyclohexane diol, cyclohexane dimethanol, and hydrogenated bisphenol A; and aromatic diols such as an ethylene oxide adduct of bisphenol A and a propylene oxide adduct of bisphenol A. Herein, bisphenol A refers to 2,2-bis(p-hydroxyphenyl)propane. As the ethylene oxide adduct of bisphenol A, there is known polyoxyethylene-2,2-bis(4-hydroxyphenyl)propane, for example. As the propylene oxide adduct of bisphenol A, there is known polyoxypropylene-2,2-bis(4-hydroxyphenyl)propane, for example. These polyhydric alcohols may be used each alone or two or more kinds of them may be used in combination.

Polyester resin can be synthesized through a normal condensation polymerization reaction. For example, polyester resin can be synthesized through a polycondensation reaction, to be specific, a dehydration condensation reaction of polybasic acids and polyhydric alcohols in the presence or absence of an organic solvent and under the presence of a catalyst. At this time, a methyl esterified compound of a polybasic acid may be used as a part of the polybasic acids so that a de-methanol polycondensation reaction can take place. The polycondensation reaction of the polybasic acids and the polyhydric alcohols may be terminated at the instant when the acid value and the softening temperature of the resultant polyester resin stand at predetermined values. In the polycondensation reaction, by properly changing the blending ratio, the reaction rate, or other factors as to the polybasic acids and the polyhydric alcohols, it is possible to control, for example, the content of carboxylic groups terminally connected to the resultant polyester resin and thus the acid value of the resultant polyester resin, and also other physical property values such as the softening temperature.

There is no particular limitation to acrylic resin for use and therefore publicly known ones can be used. For example, there are known a homopolymer of acrylic monomer and a copolymer of acrylic monomer and vinylic monomer. Among them, the use of acrylic resin having an acidic group is particularly desirable. As acrylic monomer, those used customarily as monomer of acrylic resin can be used. The examples thereof include: ester acrylate-base monomer such as an acrylic acid, a methacrylic acid, methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; and ester methacrylate-base monomer such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate. These acrylic monomers may be provided with a substituent. The examples of acrylic monomer having a substituent include: acrylic acid esters having a hydroxy group such as hydroxy ethyl acrylate and hydroxy propyl methacrylate; and ester methacrylate-base monomer. These acrylic monomers may be used each alone or two or more kinds of them may be used in combination. Moreover, as vinylic monomer, publicly known ones can be used. The examples thereof include: aromatic vinylic monomer such as styrene and α-methylstyrene; aliphatic vinylic monomer such as vinyl bromide, vinyl chloride, and vinyl acetate; and acrylonitrile-bade monomer such as acrylonitrile and methacrylonitrile. These vinylic monomers may be used each alone or two or more kinds of them may be used in combination.

The acrylic resin can be produced by subjecting one kind or two or more kinds of acrylic monomers, or one kind or two or more kinds of acrylic monomers and one kind or two or more kinds of vinylic monomers to polymerization in the presence of a radial initiator in accordance with a solution polymerization method, a suspension polymerization method, an emulsification polymerization method, or the like method. For example, the acrylic resin having an acidic group can be produced by polymerization of acrylic monomers or a combination of acrylic monomer and vinylic monomer with concurrent use of acidic group or hydrophilic group-containing acrylic monomer and/or acidic group- or hydrophilic group-containing vinylic monomer.

There is also no particular limitation to polyurethane resin for use and therefore publicly known ones can be used. For example, there are known addition polymers of polyol and polyisocyanate. Among them, the use of polyurethane resin having an acidic group or a basic group is particularly desirable. For example, the polyurethane resin having an acidic group or a basic group can be synthesized through an addition polymerization reaction of acidic group- or basic group-containing polyol and polyisocyanate. The examples of the acidic group- or basic group-containing polyol include: diols such as a dimethylol propionic acid and N-methyl diethanol amine; polyether polyol such as polyethylene glycol; and trivalent or upward polyvalent polyols such as polyester polyol, acryl polyol, and polybutadiene polyol. These polyols may be used each alone or two or more kinds of them may be used in combination. The examples of polyisocyanate include tolylene diisocyanate, hexamethylene diisocyanate, and isophorone diisocyanate. These polyisocyanates may be used each alone or two or more kinds of them may be used in combination.

There is also no particular limitation to epoxy resin for use and therefore publicly known ones can be used. The examples thereof include: bisphenol A type epoxy resin synthesized from bisphenol A and epichlorohydrin; phenol novolac type epoxy resin synthesized from epichlorohydrin and phenol novolac which is a reaction product of phenol and formaldehyde; and cresol novolac type epoxy resin synthesized from epichlorohydrin and cresol novolac which is a reaction product of cresol and formaldehyde. Among them, the use of acidic group- or basic group-containing epoxy resin is particularly desirable. For example, the acidic group- or basic group-containing epoxy resin can be produced by addition or addition polymerization of a polyvalent carboxylic acid such as an adipic acid and a trimellitic acid anhydride or amine such as dibutyl amine or ethylene diamine to such an epoxy resin as mentioned above as a base.

These binder resin materials may be used in a singular manner or in combination of two or more kinds. Moreover, with respect to resin materials of identical type, a plurality of resin materials that are different in any one or two or more of molecular weight, monomer composition, and other properties may be used in combination.

(b) Colorant

As a colorant to be mixed with the binder resin, it is possible to use any of those used customarily as toner colorants, such as publicly known dyes, organic pigments, and inorganic pigments. Specific examples thereof will be shown below according to color. Note that the term "C.I." in the following description refers to Color Index.

The examples of a black colorant include carbon black, copper oxide, manganese dioxide, aniline black, activated carbon, non-magnetic ferrite, magnetic ferrite such as magnetite.

The examples of a yellow colorant include C.I. pigment yellow 17, C.I. pigment yellow 74, C.I. pigment yellow 93, C.I. pigment yellow 155, C.I. pigment yellow 180, and C.I. pigment yellow 185.

The examples of an orange colorant include red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

The examples of a red colorant include C.I. pigment red 19, C.I. pigment red 48:3, C.I. pigment red 57:1, C.I. pigment red 122, C.I. pigment red 150, and C.I. pigment red 184.

The examples of a purple colorant include manganese purple, fast violet B, and methyl violet lake.

The examples of a blue colorant include C.I. pigment blue 15, C.I. pigment blue 15:2, C.I. pigment blue 15:3, C.I. pigment blue 16, and C.I. pigment blue 60.

The examples of a green colorant include chromium green, chromium oxide, pigment green B, mica light green lake, final yellow green G, and C.I. pigment green 7.

The examples of a white colorant include various compounds such as zinc oxide, titanium oxide, antimony white, and zinc sulfide.

These colorants may be used each alone or two or more of the colorants of different colors may be used in combination. It is also possible to use a plurality of the colorants of identical color family in combination. There is no particular limitation to the proportion of the colorant to be used with respect to the binder resin, and it can therefore be selected in a wide range in accordance with various conditions such as the kinds of the binder resin and the colorant for use and desired characteristics that the toner particles to be obtained ought to satisfy. However, preferably the proportion of the colorant is set to fall in a range of from 0.1 to 20 parts by weight, and more preferably from 5 to 15 parts by weight, with respect to 100 parts by weight of the binder resin. If the proportion of the colorant to be used is less than 0.1 parts by weight, sufficiently high coloring capability cannot be attained, and thus the amount of toner required to form an image having desired image density may be increased, which results in the possibility of an undesirable increase in toner consumption. By contrast, if the proportion of the colorant to be used is greater than 20 parts by weight, the dispersibility of the colorant in the resin kneaded product may be lowered, which results in the possibility of lack of uniformity in the resultant toner.

(c) Additive

As an additive to be added, typical toner additives such as a charge controlling agent and a release agent can be used. As the charge controlling agent, those used customarily in this field can be used. The examples thereof include calixarenes, quaternary ammonium salt compounds, nigrosin-base compounds, organic metal complex, chelate compounds, metal salt of salicylic acid such as zinc salicylate, and high polymer compounds obtained through homo-polymerization or copolymerization of monomer having an ionizable group such as a sulfonic acid group and an amino group. One kind substance may be used alone or two or more kinds of substances may be used in combination as the charge controlling agent. There is no particular limitation to the content of the charge controlling agent and it can therefore be selected in a wide range in accordance with various requirements, for example the kinds and contents of the binder resin and another component such as the colorant and the characteristics that the toner to be produced ought to satisfy. However, preferably the content of the charge controlling agent is set to fall in a range of from 0.5 to 5 parts by weight with respect to 100 parts by weight of the binder resin.

As the release agent, those used customarily in this field can also be used. For example, wax materials are known. The examples thereof include: natural waxes such as a carnauba wax and a rice wax; synthetic waxes such as a polypropylene wax, a polyethylene wax, and a Fischer-Tropsch wax; coal-base waxes such as a montan wax; petroleum-base waxes such as a paraffin wax; alcohol-base waxes; and ester-base waxes. One kind material may be used alone and two or more kinds of materials may be used in combination as the release agent. There is no particular limitation to the content of the release agent and it can therefore be selected in a wide range in accordance with various requirements, for example the kinds and contents of the binder resin and another component such as the colorant and the characteristics that the toner to be produced ought to satisfy. However, preferably the content of the release agent is set to fall in a range of from 5 to 10 parts by weight with respect to 100 parts by weight of the binder resin. If the content of the release agent is less than 5 parts by weight, it may become impossible to take advantage of the effect of enhancing the low-temperature fixing property and the anti-hot offset property. By contrast, if the content of the release agent is greater than 10 parts by weight, the dispersibility of the release agent in the resin kneaded product may be lowered, which results in the possibility of lack of uniformity in the characteristics of the resultant toner. Moreover, a so-called filming phenomenon may occur; that is, toner is liable to be fusion-attached in the form of a film onto a surface of an image carrier for holding an electrostatic charge image, such as a photoreceptor.

The resin kneaded product can be obtained by, for example, dry-mixing the binder resin and the colorant in appropriate amounts, and also, optionally, various additives such as the aforesaid charge controlling agent in appropriate amounts by a mixer, and melt-kneading the resultant admixture through application of heat at a temperature which is equal to or higher than the softening temperature of the binder resin but lower than the thermal decomposition temperature thereof, specifically, a temperature ranging from 80° C. to 200° C., and preferably a temperature ranging from 100° C. to 150° C. Note that the constituents for toner such as the binder resin and the colorant may be directly melt-mixed without carrying out the dry-mixing step. However, it is preferable that, as practiced in this embodiment, the constituents for toner are dry-mixed first and then melt-kneaded from the standpoint of enhancing the dispersibility of the component such as the colorant in the binder resin so as to attain uniformity even further in the characteristics, such as the charging capability, of the toner to be obtained.

As the mixer used for the dry-mixing step, publicly known ones can be used. The examples thereof include: Henschel type mixing apparatuses such as HENSCHEL MIXER (trade name) manufactured by Mitsui Mining Co., Ltd., SUPER MIXER (trade name) manufactured by Kawata Co., Ltd., and MECHANO MILL (trade name) manufactured by Okada Seiko Co., Ltd.; ONG MILL (trade name) manufactured by Hosokawa Micron Corporation; HYBRIDIZATION SYSTEM (trade name) manufactured by Nara Machinery Co., Ltd.; and COSMO SYSTEM (trade name) manufactured by Kawasaki Heavy Industries, Ltd. For the melt-kneading step, typical kneading machines can be used such as a kneader, a twin-screw extruder, a two-roll mill, a three-roll mill, and a laboratory blast mill. The examples of typical kneading machines include: single- or twin-screw extruders such as TEM-100B (trade name) manufactured by Toshiba Machine Co., Ltd. and PCM-65/87 and PCM-30 (trade names) manufactured by Ikegai Co., Ltd.; and kneaders of open roll type such as KNEADEX (trade name) manufactured by Mitsui Mining Co., Ltd. The melt-kneading step may be carried out by a plurality of kneading machines.

The resin kneaded product thus obtained ranges in softening temperature from 80° C. to 150° C. for example, and preferably 100° C. to 130° C. Moreover, it is preferable that the resin kneaded product exhibits a loss elastic modulus G" of $10^5$ Pa or below at a temperature at which a dispersant-containing aqueous medium is heated in the granulation step at Step s3 (hereafter also referred to as "the granulation temperature"). The reason therefor, as well as the granulation step, will be explained later on. Adjustment of the softening temperature and the melt viscosity of the resin kneaded product at the granulation temperature can be made by, for example, properly selecting the kinds of components to be contained in the resin kneaded product and their mixing proportions.

[Aqueous Medium Preparation Step]

In the aqueous medium preparation step at Step s2, an aqueous medium containing a dispersant and water (hereafter referred to as "the dispersant-containing aqueous medium") is prepared. Although the dispersant of the dispersant-containing aqueous medium may be kept in either a dissolved-in-water state or a dispersed-in-water state, in order to achieve efficient granulation of the resin kneaded product in the subsequently-described granulation step at Step s3, the dispersant should preferably be kept in the dissolved-in-water state. That is, as the dispersant, a water-soluble substance is preferably used. In a case where a water-insoluble substance is used as the dispersant, the dispersant exists as a solid matter in the admixture of the resin kneaded product and the dispersant-containing aqueous medium. In this case, the dispersant behaves like a boiling stone during the course of the granulation step, thus causing generation of minute air bubbles on the surface of the dispersant. As a result, foaming takes place with the air bubbles acting as an active spot, which impairs the progress of stirring in an stirring apparatus as a whole and thus shearing with respect to the resin kneaded product. This could lead to a failure of granulation. The use of a water-soluble substance as the dispersant makes it possible to prevent generation of air bubbles from the dispersant during the course of the granulation step, and thereby achieve efficient granulation of the resin kneaded product. As another advantage, since a water-soluble substance can be removed easily in the subsequently-described cleaning step at Step s6, it is possible to prevent the dispersant from remaining in the resultant toner.

As the water-dissoluble dispersant, for example, water-soluble polymeric compounds and surfactants can be used. The examples of water-soluble polymeric compounds include: styrene-vinylcarboxylic acid-base copolymers such as a styrene-acrylic acid copolymer, a styrene-α-methylstyrene-acrylic acid copolymer, and a styrene-maleic acid copolymer; styrene-vinylcarboxylic acid-base copolymer salts such as a styrene-acrylic acid copolymer ammonium salt and a styrene-α-methylstyrene-acrylic acid copolymer ammonium salt; polyvinyl alcohol; polyvinyl pyrrolidone; and hydroxy cellulose. As the surfactant, any of a nonionic surfactant, an anionic surfactant, and a cationic surfactant can be used. The specific examples thereof include sodium dodecyl sulfate, sodium tetradecyl sulfate, sodium pentadecyl sulfate, sodium octyl sulfate, sodium oleate, sodium laurate, potassium stearate, and calcium oleate. These dispersant materials may be used in a singular manner or in combination of two or more kinds.

Among the aforementioned water-dissoluble dispersant materials, it is desirable to use water-soluble polymeric compounds, and more particularly styrene-vinylcarboxylic acid-base copolymers. In the case of using surfactants, the admixture may froth up during the course of the granulation step at Step s3 that could impair the granulation of the resin kneaded product. The use of water-soluble polymeric compounds as the dispersant makes it possible to avoid occurrence of frothing which is ascribable to the use of surfactants, and thereby achieve the granulation of the resin kneaded product more efficiently in the granulation step at Step s3.

It is preferable that a water-soluble polymeric compound to be used ranges in weight average molecular weight from 5000 to 50000, and more preferably from 5000 to 20000. If the weight average molecular weight of the water-soluble polymeric compound is less than 5000, there may be a case where unreacted monomer remains in the water-soluble polymeric compound, which could result in the water-soluble polymeric compound failing to serve the desired dispersant functions. By contrast, if the weight average molecular weight of the water-soluble polymeric compound is greater than 50000, its water solubility becomes so poor that the granulation of the resin kneaded product may be impaired. Note that the weight average molecular weight of the water-soluble polymeric compound takes on a value obtained by measurement in accordance with gel permeation chromatography (GPC for short) on a polystyrene basis.

There is no particular limitation to the content of the dispersant, namely the concentration of the dispersant, in the dispersant-containing aqueous medium and it can therefore be selected in a wide range. However, in consideration of the ease of operation for mixing the resin kneaded product and the dispersant-containing aqueous medium, the dispersion stability of the resultant resin particles containing the colorant, and the like factors, the content (concentration) of the dispersant is preferably adjusted to fall in a range of from 5% to 40% by weight with respect to the total amount of the dispersant-containing aqueous medium at room temperature (approximately 25° C.). If the concentration of the dispersant is less than 5% by weight, a larger amount of the dispersant-containing aqueous medium is required to make ideal the proportion of the dispersant to be used to the resin kneaded product in the subsequently-described granulation step at Step s3. This complicates the operation for mixing the resin kneaded product and the dispersant-containing aqueous medium. By contrast, if the concentration of the dispersant is greater than 40% by weight, the viscosity of the dispersant-containing aqueous medium becomes so high that air bubbles tend to be generated. As a result, the granulation of the resin kneaded product may be impaired.

For example, the dispersant-containing aqueous medium can be prepared by dissolving or dispersing an appropriate amount of the dispersant such as shown hereinabove into water. At this time, it is desirable to use water having an electrical conductivity of 20 μS/cm or below. Such water as has an electrical conductivity falling in this range can be prepared by, for example, an activated carbon method, an ion exchange method, a distillation method, and a reverse osmosis method. Moreover, two or more of these methods may be used in combination to obtain the water having an electrical conductivity falling in the range. Further, the water may be prepared by a commercially available pure water manufacturing apparatus, for example, MINIPURE TW-300 RU (trade name) manufactured by Nomura Micro Science Co., Ltd.

[Granulation Step]

In the granulation step at Step s3, the resin kneaded product obtained in the kneading step at Step s1 and the dispersant-containing aqueous medium prepared in the aqueous medium preparation step at Step s2 are mixed together. After that, the dispersant-containing aqueous medium contained in the admixture thus obtained is heated at a predetermined temperature and simultaneously the admixture is stirred to granulate the resin kneaded product. In this way, colorant-containing resin particles can be formed, as toner particles, in the dispersant-containing aqueous medium. In this embodiment, for the granulation of the resin kneaded product, the admixture is heated and stirred in an stirring apparatus 1 shown in FIGS. 2 and 3.

Figure 2:
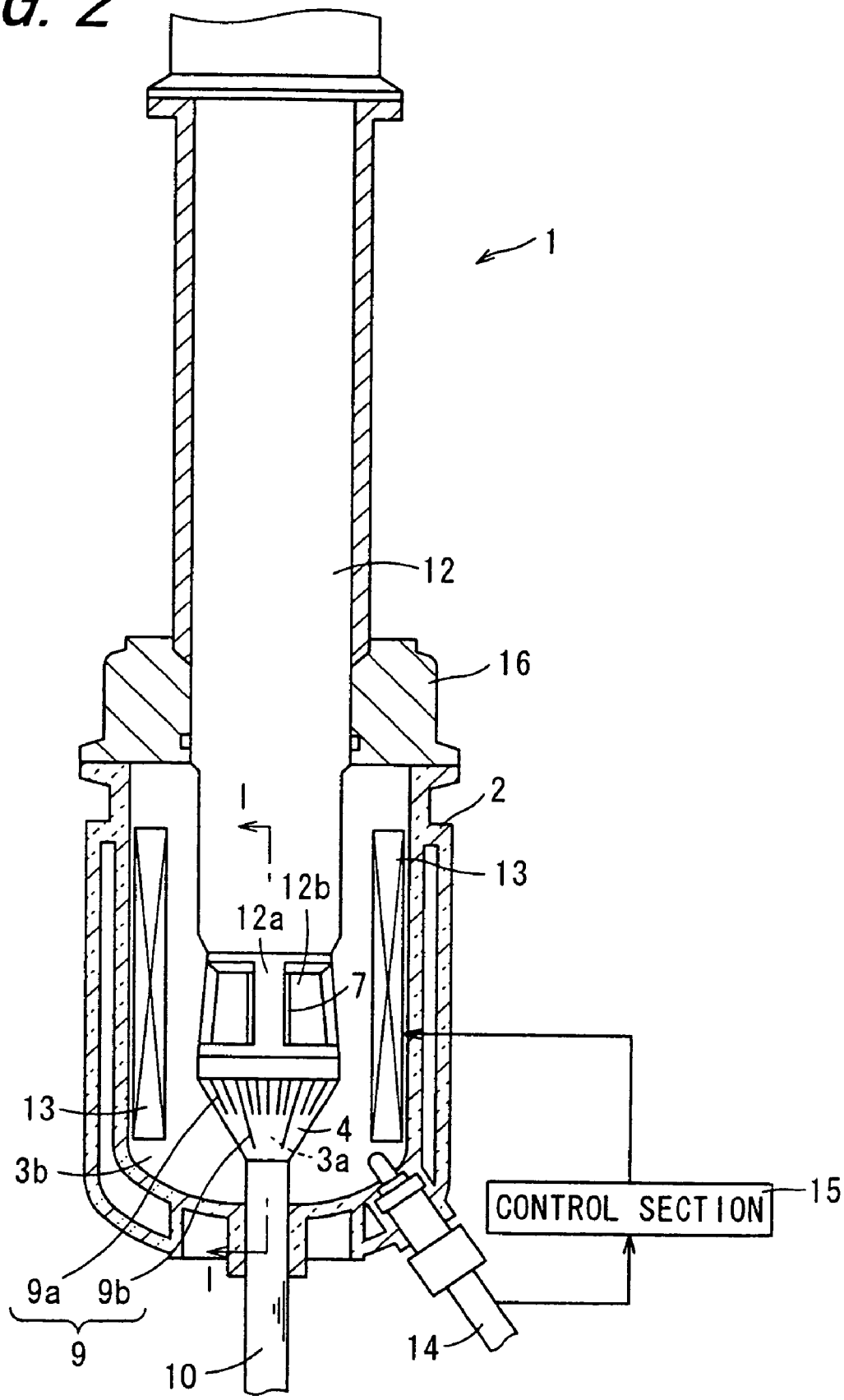
FIG. 2 is a partial sectional view showing the structure of the stirring apparatus in simplified form that is suitable for use in toner production according to the embodiment.
Figure 3:
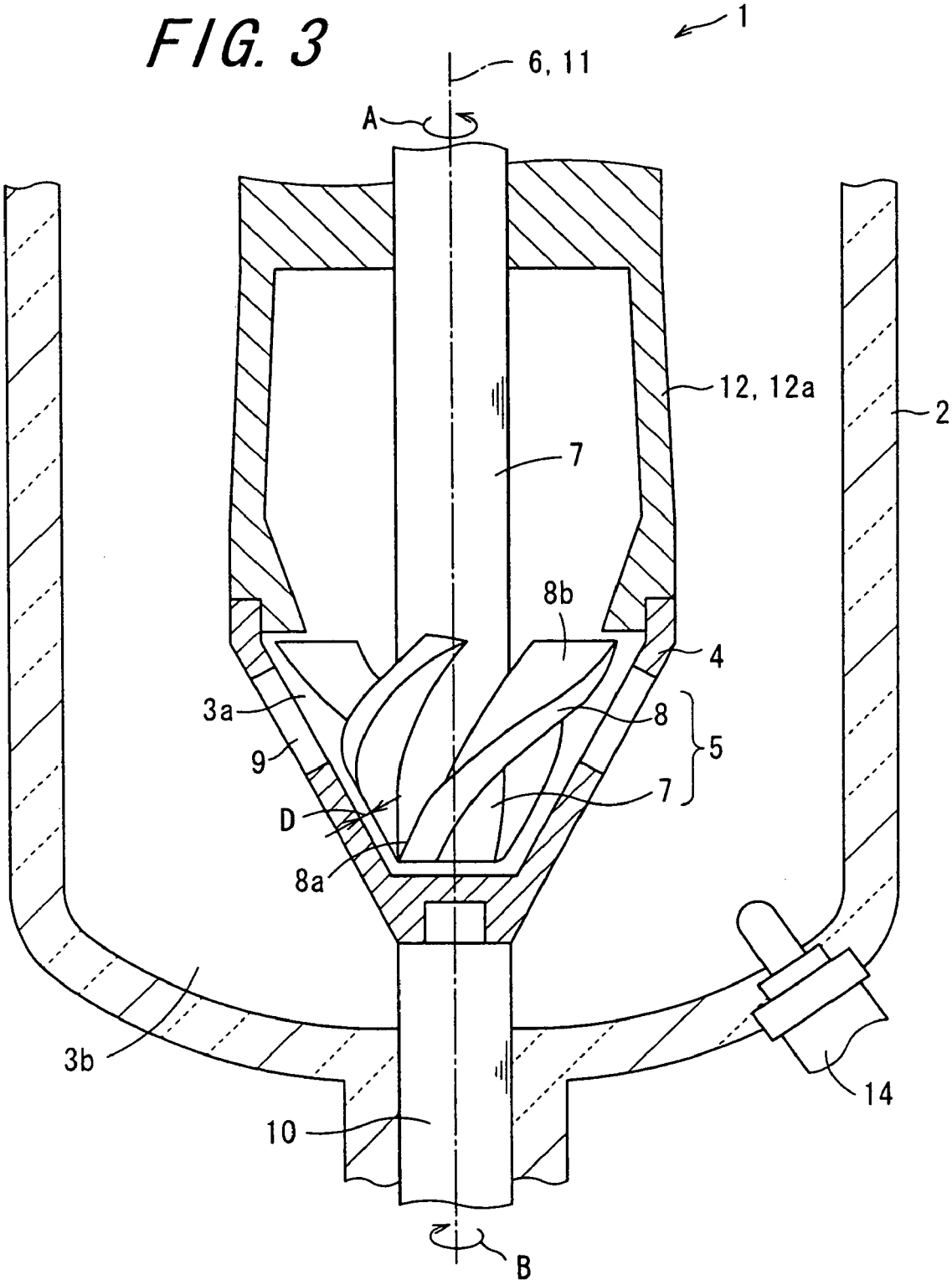
FIG. 3 is a view showing a screen and its environs depicted in FIG. 2 in enlarged form.

FIG. 2 is a partial sectional view showing the structure of the stirring apparatus 1 in simplified form that is suitable for use in toner production according to the embodiment. FIG. 3 is a view showing a screen 4 and its environs depicted in FIG. 2 in enlarged form. FIG. 3 is shown as a partial sectional view taken along a virtual plane including the section line I-I of FIG. 2. In FIG. 3, a heater 13 depicted in FIG. 2 is omitted for the sake of avoiding complication of illustration causative of difficulty in understanding of the invention. Moreover, in FIG. 3, a vessel 2 depicted in FIG. 2 is simplified. The stirring apparatus 1 basically includes a screen 4 and a rotor 5. The screen 4, which is disposed internally of the vessel 2 for housing therein the admixture of the resin kneaded product and the dispersant-containing aqueous medium, acts as an stirring space forming member for partitioning a space within the vessel 2 into an stirring space 3*a* in which the admixture is stirred and a space 3*b* outside the stirring space. The rotor 5 acts as an stirring section for stirring the admixture accommodated in the stirring space 3*a*.

The vessel 2 is made pressure-resistant and is designed to block heat transfer between within and without thereof. Although not shown in the figure, the vessel 2 is provided with a pressure control valve whereby to control the pressure inside the vessel 2 properly.

The rotor 5 includes a rotary shaft member 7 which is rotatable about an axis of rotation 6 and a blade member 8 which is formed on the outer peripheral surface of the rotary shaft member 7 so as to extend radially outwardly of the rotary shaft member 7. In this embodiment, the rotary shaft member 7 is formed in the shape of a cylindrical column. By a driving section (not illustrated), the rotary shaft member 7 is driven to rotate about the axis of rotation 6 in one circumferential direction indicated by an arrow A.

The blade member 8 is so configured as to extend gradually in one circumferential direction of the rotary shaft member 7 with increasing proximity to one axial direction-wise side of the rotary shaft member 7. In accompaniment with the rotation of the rotary shaft member 7, the blade member 8 is rotated in one circumferential direction indicated by the arrow A. Moreover, the blade member 8 is so designed that its one circumferential direction-wise surface is made as a curved surface, and the angle that the curved surface forms with the axis of rotation 6 becomes larger gradually from a base end 8*a* fixed to the rotary shaft member 7 to a free end 8*b*. In this embodiment, the rotor 5 has a plurality of the blade members 8 spaced at a predetermined interval circumferentially of the rotary shaft member 7. The rotary shaft member 7 and the blade member 8 are formed integrally with each other by using a rigid material such as stainless steel.

According to the rotor 5, as the rotary shaft member 7 is rotated about the axis of rotation 6 in one circumferential direction, namely the direction of arrow A, the blade members 8 are rotated in one circumferential direction correspondingly. In this way, the admixture accommodated in the stirring space 3*a* can be stirred.

The screen 4 is disposed away from the blade members 8 so that the blade members 8 of the rotor 5 is surrounded with the screen 4. For example, the screen 4 is made of a rigid material such as stainless steel. The configuration of the screen 4 is selected in accordance with the shape of the blade member 8 in a manner so as to insure that a distance D between the screen 4 and the blade member 8 is maintained constant throughout the direction in which the blade member 8 is rotated and also throughout the axial direction of the rotary shaft member 7. In this embodiment, since the blade member 8 of the rotor 5 is so configured as to extend gradually in one circumferential direction of the rotary shaft member 7 with increasing proximity to one axial direction-wise side of the rotary shaft member 7, it follows that the screen 4 has the shape of a circular truncated cone whose cross-sectional area becomes smaller gradually with increasing proximity to the other axial direction-wise side of the rotary shaft member 7 of the rotor 5. Herein, the distance D between the screen 4 and the blade member 8 defines the shortest interval therebetween. There is no particular limitation to the distance D between the screen 4 and the blade member 8.

The screen 4 is provided with an admixture discharge hole 9 for providing communication between the stirring space 3*a* and the space 3*b* outside the stirring space. Note that, in FIG. 2, the admixture discharge hole 9 is illustrated as a line segment for the sake of avoiding complication of illustration causative of difficulty in understanding of the invention. In this embodiment, the admixture discharge hole 9 is formed in the shape of a slit extending substantially parallel with a virtual plane including the axis of rotation 6 of the rotary shaft member 7 of the rotor 5. Herein, the term "substantially parallel" also denotes "parallel".

The admixture discharge hole 9 is composed of a first admixture discharge hole 9*a* and a second admixture discharge hole 9*b* which is longitudinally longer than the first admixture discharge hole 9*a*. In this embodiment, a plurality of the first admixture discharge holes 9*a* are spaced apart circumferentially of the screen 4. Moreover, a plurality of the second admixture discharge holes 9*b* are also spaced apart circumferentially of the screen 4. In this embodiment, the number of the first admixture discharge holes 9*a* is larger than that of the second admixture discharge holes 9*b*. The first and second admixture discharge holes 9*a* and 9*b* are so arranged that several first admixture discharge holes 9*a* are spaced at a predetermined interval between the adjacent second admixture discharge holes 9*a* spaced at a predetermined interval. There is no particular limitation to the width of the first and second admixture discharge holes 9*a* and 9*b*.

The screen 4 is rotatably supported by a screen support 12 formed so as to extend in the axial direction of the rotary shaft member 7 of the rotor 5. In this embodiment, the screen 4 has its one end which faces one axial direction-wise side of the rotary shaft made engageable with the screen support 12; that is, the screen 4 is engageably supported by the screen support 12.

In the screen support 12, its front end-sided part which is engaged with the screen 4 has a cylindrical shape. In this embodiment, that part of the screen support 12 which is cylindrically shaped (hereafter referred to as "the cylindrical-shaped portion 12*a*") is given the shape of a circular cylinder. The cylindrical-shaped portion 12*a* of the screen support 12 partitions further the space 3*b* outside the stirring space created by the screen 4 acting as a partition. The cylindrical-shaped portion 12*a* of the screen support 12 is provided with an admixture supply hole 12*b* for providing communication between a space inside the cylindrical-shaped portion 12*a* and a space external to the cylindrical-shaped portion 12*a*. As the blade members 8 of the rotor 5 are rotated, the admixture accommodated in the space 3*b* outside the stirring space flows into the space inside the cylindrical-shaped portion 12*a* through the admixture supply hole 12*b*, and eventually enters the stirring space 3*a*.

Moreover, the screen 4 has its other end which faces the other axial direction-wise side of the rotary shaft made engageable to a screen rotary shaft member 10 which is so formed as to extend in the axial direction of the rotary shaft member 7 of the rotor 5. That is, the screen 4 is engageably supported also by the screen rotary shaft member 10. The screen rotary shaft member 10 is made rotatable about an axis of rotation 11 which is substantially in parallel with the axis of rotation 6 of the rotary shaft member 7 of the rotor 5. By a driving section (not illustrated), the screen rotary shaft member 10 is driven to rotate about the axis of rotation 11. The screen 4 is rotated about the axis of rotation 11 by rotatably driving the screen rotary shaft member 10. In this embodiment, the axis of rotation 11 of the screen 4 substantially conforms to the axis of rotation 6 of the rotary shaft member 7. Herein, the term "substantially conform" also denotes "conform". Further, the screen 4 is rotated about the axis of rotation 11 in a direction reverse to the direction of arrow A in which the rotary shaft member 7 of the rotor 5 is rotated, namely in the other circumferential direction indicated by an arrow B.

The stirring apparatus 1 is, with its use, so arranged that the other axial direction-wise side of the rotary shaft member 7 of the rotors stands vertical. The stirring apparatus 1 further comprises: the heater 13 acting as a heating section for applying heat to the admixture housed in the vessel 2; a thermometer 14 acting as a temperature measurement section for measuring the temperature of the aqueous medium housed in the vessel 2; and a control section 15. For example, the heater 13 can be realized by the use of a coil. The coil is wound in one direction in which the rotary shaft member 7 of the rotor 5 is rotated. The thermometer 14 is so disposed as to protrude into the vessel 2. The components constituting the stirring apparatus 1 are each operated under the control of the control section 15. More specifically, the control section 15 controls the operation of the heater 13. The output of the thermometer 14 is fed to the control section 15. In response to the output result fed from the thermometer 14, the control section 15 controls the operation of the heater 13. For example, the control section 15 can be realized by the use of a micro computer. Moreover, the stirring apparatus 1 is provided with a mechanical seal 16 so as to cover the opening of the vessel 2. That is, the vessel 2 is hermetically sealed with the mechanical seal 16.

The stirring apparatus 1 shown in FIG. 2 is commercially available as a dispersing apparatus or an emulsifying apparatus. As one example of products on the market, CLEAR MIX (trade name) manufactured by M Technique Co., Ltd. is known.

Following is a specific explanation as to the granulation step effected by the stirring apparatus 1 in accordance with the embodiment. At first the resin kneaded product and the dispersant-containing aqueous medium are charged into the vessel 2 of the stirring apparatus 1. The charged resin kneaded product and the dispersant-containing aqueous medium are accommodated in the stirring space 3*a* and the space 3*b* outside the stirring space created by the screen 4 acting as a partition.

Although the resin kneaded product and the dispersant-containing aqueous medium may be charged into the vessel 2 separately, preferably they are charged into the vessel 2 together in the form of admixture. In this case, it is possible to improve the uniformity of the admixture, and thereby allow easy formation of colorant-containing resin particles with narrow particle size distribution and uniform particle diameter. As the resin kneaded product, a product obtained by melting and kneading the constituents for toner such as the binder resin and the colorant may be used as it is in a molten state. It is also possible to use a solidification product obtained by cooling the melt-kneaded product, or a product obtained by bringing the solidification product into the molten state again through application of heat.

Next, after the vessel 2 is hermetically sealed with the mechanical seal 16, the heater 13 is activated to start heating for the admixture, and simultaneously the rotary shaft member 7 of the rotor 5 and the screen 4 are started in rotation. In this embodiment, the screen 4 is rotated in a direction reverse to the direction in which the rotary shaft member 7 of the rotor 5 is rotated. In the stirring space 3*a*, as the rotary shaft member 7 of the rotor 5 is rotatably driven, the blade members 8 are rotated, and thereby the admixture is stirred while receiving application of kinetic energy. The admixture, now having kinetic energy imparted thereto through the stirring in the stirring space 3*a*, is, in the admixture discharge hole region of the screen 4 where the admixture discharge hole 9 is formed, discharged into the space 3*b* outside the stirring space through the admixture discharge hole 9, but is, in a region of the screen 4 exclusive of the admixture discharge hole region, caused to run against the screen without being discharged into the space 3*b* outside the stirring space. Therefore, the flow of the admixture to be discharged into the space 3*b* outside the stirring space is blocked in the region of the screen 4 exclusive of the admixture discharge hole region, thus causing intermittent admixture flow. That is, in the stirring apparatus 1, as the admixture accommodated in the stirring space 3*a* is stirred by the rotor 5, the admixture can be discharged through the admixture discharge hole 9 into the space 3*b* outside the stirring space on an intermittent basis.

In this way, by discharging the admixture accommodated in the stirring space 3*a* into the space 3*b* outside the stirring space on an intermittent basis, it is possible to apply a shear force between the admixture portion being discharged through the admixture discharge hole 9 into the space 3*b* outside the stirring space and the admixture portion remaining in the stirring space 3*a*. Particularly, in this embodiment, the blade member 8 of the rotor 5 is so configured as to extend gradually in one circumferential direction of the rotary shaft member 7 with increasing proximity to one axial directionwise side of the rotary shaft member 7, and the admixture discharge hole 9 of the screen 4 is so configured as to extend substantially parallel with the virtual plane including the axis of rotation 6 of the rotary shaft member 7. This makes it possible to develop a great shear force. Moreover, the admixture portion having been discharged through the admixture discharge hole 9 runs against the admixture portion originally accommodated in the space 3*b* outside the stirring space. At this time, a collision force is developed between the admixture portion having been discharged through the admixture discharge hole 9 and the admixture portion originally accommodated in the space 3*b* outside the stirring space.

The admixture is heated by the heater 13, wherefore the resin kneaded product contained in the admixture is kept in a softened state. By the shear force and the collision force developed when the admixture is discharged through the admixture discharge hole 9, the resin kneaded product is pulverized and granulated. The admixture portion discharged into the space 3*b* outside the stirring space is allowed to flow along the inner surface part of the vessel 2 by the rotation of the rotor 5, then pass through the admixture supply hole 12*b* of the screen support 12 and the space inside the cylindrical-shaped portion 12*a*, and eventually enter the stirring space 3*a* once again. In this way, the resin kneaded product can be pulverized repeatedly while the admixture is being circulated with stirring. The resin kneaded product thus pulverized is dispersed in the dispersant-containing aqueous medium, whereupon, as toner particles, colorant-containing resin particles can be formed in the dispersant-containing aqueous medium.

As described just above, in this embodiment, by virtue of the shear force and the collision force developed when the admixture is discharged through the admixture discharge hole 9, the resin kneaded product contained in the admixture can be pulverized with ease. Accordingly, even if the temperature set for the aqueous medium is lower than the softening temperature of the resin kneaded product, the resin kneaded product can be granulated without any problem. That is, according to the embodiment, the temperature set for the aqueous medium can be kept at a lower level without deteriorating the granulability of the resin kneaded product. In this case, since the agglomeration of various components contained in the resin kneaded product, such as the colorant, the charge controlling agent, and the release agent can be avoided during the course of the granulation step, it is possible to assure that these constituent components remain in the same dispersed state as observed at the time of preparation of the resin kneaded product in the kneading step. Moreover, since the constituent components can be prevented from separating from the resin kneaded product, it is possible to avoid deviation of the composition of the resultant colorant-containing resin particles, namely toner particles from the composition of the resin kneaded product, and thereby produce a toner having the desired characteristics with stability. Further, a decrease in the temperature set for the aqueous medium in the granulation step is desirable in that it contributes to saving in energy required for heating the aqueous medium by the heater 13, as well as in energy required for cooling the aqueous medium in the subsequently-described cooling step, and thus leads to a reduction in power consumption.

In order to achieve the granulation of the resin kneaded product more reliably, it is desirable to adjust the rotational circumferential velocity (hereafter also referred to simply as "the circumferential velocity") of the blade member 8 of the rotor 5 to exceed 3.7 m/s. This makes it possible to impart ideal kinetic energy to the admixture through the rotation of the blade member 6 in the stirring space 3*a*, and thereby apply, to the admixture, a shear force and a collision force sufficient to pulverize the resin kneaded product contained in the admixture when the admixture is discharged through the admixture discharge hole 9. Hence, the granulation of the resin kneaded product can be achieved more reliably. In the following description, there may be cases where the circumferential velocity of the blade member is called "the circumferential velocity of the rotor".

If the circumferential velocity of the blade member 8 is equal to or less than 3.7 m/s, the shear force and the collision force developed when the admixture is discharged through the discharge hole 9 become insufficient, which results in the possibility of difficulty in the granulation of the resin kneaded product. Furthermore, much time needs to be taken to complete formation of particles having desired particle diameter and desired particle size distribution, which could lead to poor productivity.

Although the upper limit of the circumferential velocity of the blade member 8 is not particularly restricted, preferably it is set at or below 40 m/s. If the circumferential velocity of the blade member 8 is greater than 40 m/s, the quantity of heat liberated by the rotatory motion of the rotary shaft member 7 and the blade member 8 becomes so large that the aqueous medium may be heated to a temperature higher than the heating temperature set for the heater 13 in the stirring space 3*a*. This makes it difficult to properly adjust the temperature of the aqueous medium housed in the vessel 2, which results in the possibility of a failure of taking advantage of the effect of the invention, namely the effect of suppressing variation in the dispersibility and the composition of the components contained in the resin kneaded product by lowering the temperature at which the aqueous medium is heated in the granulation step.

Moreover, in this embodiment, since the screen 4 and the rotary shaft member 7 of the rotor 5 are mutually rotated in opposite directions, it follows that the screen 4 and the blade member 8 of the rotor 5 are mutually rotated in opposite directions, too. In this case, as compared with the case where the screen 4 is at rest and the case where the screen 4 and the blade member 8 are rotated in the same direction, the flow of the admixture to be discharged from the discharge hole 9 is blocked more frequently. This makes it possible to intensify the shear force and the collision force that the admixture receives when it is discharged from the discharge hole 9, and thereby achieve the granulation of the resin kneaded product more efficiently. Accordingly, such colorant-containing resin particles as have a small volumetric average particle diameter ranging, for example, from 3 μm to 8 μm can be formed more easily.

It is preferable that the ratio of the number of rotation s of the screen 4 to the number of rotations of the rotary shaft member 7 of the rotor 5 (the number of rotations of the screen 4/the number of rotations of the rotary shaft member 7) is set at or above 0.50. This makes it possible to suitably adjust the frequency with which the flow of the admixture to be discharged from the discharge hole 9 is blocked, and thereby impart a shear force and a collision force ideal for the granulation of the resin kneaded product to the admixture. If the ratio of the number of rotations of the screen 4 to the number of rotations of the rotary shaft member 7 is less than 0.50, it becomes impossible to take advantage of the effect achieved by rotating the screen 4, which results in the possibility of difficulty in the formation of colorant-containing resin particles having the desired particle diameter and the desired particle size distribution.

Although the upper limit of the ratio of the number of rotations of the screen 4 to the number of rotations of the rotary shaft member 7 (the number of rotations of the screen 4/the number of rotations of the rotary shaft member 7) is not particularly restricted, from the standpoint of operating the stirring apparatus 1 with stability, the ratio of the number of rotations of the screen 4 to the number of rotations of the rotary shaft member 7 is preferably set at or below 0.95. The greater is the kinetic energy imparted to the admixture by the blade members 8 of the rotor 5, the greater are the shear force and the collision force developed when the admixture is discharged through the discharge hole 9. Accordingly, the larger the number of rotations of the rotary shaft member 7 defining the circumferential velocity of the blade member 8 of the rotor 5 is set the better. It is thus inefficient to adjust the number of rotations of the screen 4 to be larger than the number of rotations of the rotary shaft member 7; that is, to set the ratio of the number of rotations of the screen 4 to the number of rotations of the rotary shaft member 7 at a value greater than 1.00. Moreover, if the ratio of the number of rotations of the screen 4 to the number of rotations of the rotary shaft member 7 exceeds 0.95, the rotor 5 and the screen 4 cannot be rotated with stability, which results in the possibility that the rotor 5 or the screen 4 will come off the support. For this reason, the ratio of the number of rotations of the screen 4 to the number of rotations of the rotary shaft member 7 is set at or below 0.95.

It is preferable that the temperature set for the aqueous medium in the granulation step, namely, the granulation temperature, is set at or above a value obtained by subtracting 20 (° C.) from Tm (° C.) (Tm−20[° C.]). Tm (° C.) represents the softening temperature of the resin kneaded product contained in the admixture. If the granulation temperature takes on a value which is smaller than the value obtained by subtracting 20 (° C.) from the softening temperature of the resin kneaded product Tm (° C.) (Tm−20[° C.]), the resin kneaded product cannot be softened sufficiently, which could lead to the difficulty in granulation. Furthermore, much time needs to be taken to complete the formation of colorant-containing resin particles (toner particles) having the desired particle diameter and the desired particle size distribution, which results in the possibility of poor productivity. It is desirable to keep the granulation temperature as low as possible so long as the condition that it is set at or above the value obtained by subtracting 20 (° C.) from the softening temperature of the resin kneaded product Tm (° C.) (Tm−20[° C.]) is satisfied. However, the value of the granulation temperature must be selected from values which are smaller than the thermal decomposition temperature of the resin kneaded product lest various components contained in the resin kneaded product such as the binder resin should be thermally decomposed. Herein, the term "the thermal decomposition temperature of the resin kneaded product" refers to the lowest one of the values representing the thermal decomposition temperatures of the components contained in the resin kneaded product.

Moreover, in order to achieve the granulation of the resin kneaded product more reliably, as has already been explained, the loss elastic modulus G" of the resin kneaded product at the granulation temperature should preferably be kept at or below $10^5$ Pa. In other words, it is preferable that the granulation temperature is selected in a manner so as to insure that the loss elastic modulus G" of the resin kneaded product is kept at or below $10^5$ Pa. If the loss elastic modulus G" of the resin kneaded product at the granulation temperature exceeds $10^5$ Pa, there arise the possibility of difficulty in the granulation. Furthermore, much time needs to be taken to complete the formation of toner particles having the desired particle diameter and the desired particle size distribution, which could lead to poor productivity.

Although the lower limit of the melt viscosity of the resin kneaded product at the granulation temperature is not particularly restricted, it is preferable that the resin kneaded product is made not to have too low a melt viscosity. This is because, if the resin kneaded product is softened excessively, there may occur the agglomeration of various components dispersed in the resin kneaded product, such as the colorant, the charge controlling agent, and the release agent, which could lead to poor dispersibility. Furthermore, there may occur the separation of the components contained in the resin kneaded product, which could lead to deviation of the composition of the colorant-containing resin particles to be obtained from the composition of the resin kneaded product as observed at the time of preparation in the kneading step.

Herein, the term "the loss elastic modulus G"" refers to the imaginary number part of complex elastic modulus obtained by dynamic viscoelasticity measurement.

In the stirring apparatus 1, it is preferable that application of heat to the aqueous medium and stirring for the admixture are carried out, with the vessel 2 placed in a pressurized state. This makes it possible to increase the boiling point of water contained in the aqueous medium, and thereby heat the aqueous medium to 100° C. or above without bringing it to a boil. Accordingly, an undesirable decrease in the shear force and the collision force resulting from generation of air bubbles can be prevented, wherefore the granulation of the resin kneaded product can be achieved more efficiently. The pressure in the vessel 2 can be controlled by the non-illustrated pressure control valve disposed in the vessel 2. For example, the pressure in the vessel 2 is set to fall in a range of from 0.1 MPa (ca. 1 atm) to 1 MPa (ca. 10 atm). Herein, the term "the pressurized state" refers to a state in which a pressure exceeding atmospheric pressure (1 atm) is applied.

However, if the pressure in the vessel 2 is unduly high, the air bubbles generated in the admixture may not disappear, become minuter under the pressure, and be confined within the system. This could impair the granulation of the resin kneaded product. Therefore, the pressure in the vessel 2 should preferably be kept at a minimum so long as the admixture can be prevented from being boiled at the predetermined granulation temperature. The pressure in the vessel 2 is thus selected properly in accordance with the temperature at which the aqueous medium is heated, namely, the granulation temperature. For example, in a case where the granulation temperature is set at 120° C., the pressure in the vessel 2 is adjusted to be approximately 0.2 MPa (ca. 2 atm). Note that, in a case where the granulation temperature is lower than 100° C., there is no need to apply any pressure in the vessel 2.

Moreover, in this embodiment, the granulation is carried out in a batch-wise manner. In this case, in contrast to the case of carrying out the granulation in a continuous manner, the temperature of the admixture housed in the vessel 2 and thus the temperature of the aqueous medium can be controlled more precisely, wherefore the granulation of the resin kneaded product can be achieved more efficiently. It is also possible to produce a toner having the desired characteristics with higher stability.

There is no particular limitation to the length of time that the stirring apparatus 1 continues to stir the admixture, and it can therefore be selected in a wide range in accordance with various requirements such as the number of rotation of the rotor 5, the number of rotation of the screen 4, the kind and the amount of use of the binder resin contained in the admixture, the kind and the concentration of the dispersant contained in the dispersant-containing aqueous medium, and the temperature at which the aqueous medium is heated (the granulation temperature).

It is preferable that the amount of use of the dispersant-containing aqueous medium is selected, depending upon the concentration of the dispersant, in a manner so as to insure that the content of the dispersant falls in a range of from 5 to 200 parts by weight with respect to 100 parts by weight of the resin kneaded product. If the content of the dispersant is less than 5 parts by weight, formation of oversized colorant-containing resin particles cannot be prevented successfully, which could lead to an undesirable increase in the particle diameter and the particle size distribution range of the resultant toner particles. By contrast, if the content of the dispersant is greater than 200 parts by weight, the viscosity of the dispersant-containing aqueous medium becomes so high that the resultant colorant-containing resin particles may not be dispersed in the dispersant-containing aqueous medium with stability.

Moreover, from the standpoint of efficiently conducting the predetermined operations such as the mixing of the dispersant-containing aqueous medium with the resin kneaded product and the subsequently-described cleaning and isolation of the colorant-containing resin particles, it is preferable that the amount of use of the dispersant-containing aqueous medium is set to fall in a range of from 100 to 2000 parts by weight with respect to 100 parts by weight of the resin kneaded product. That is, it is preferable that the concentration of the dispersant in the dispersant-containing aqueous medium is so determined as to satisfy the above-described ideal proportion of the dispersant to be used to the resin kneaded product, as well as the ideal proportion of the dispersant-containing aqueous medium to be used.

In the embodiment thus far described, the rotor 5 is used as an stirring section for stirring the admixture accommodated in the stirring space 3*a* by exploiting rotatory motion. Although the stirring section is not limited to the rotor 5 but may be of another mechanism such as that which stirs the admixture by exploiting, for example, reciprocating motion or swinging motion, it is desirable to adopt the stirring section for stirring the admixture by exploiting rotatory motion, as practiced in the embodiment. By virtue of such an stirring section, the admixture in the stirring space 3*a* can be stirred evenly and then discharged into the space 3*b* outside the stirring space one after another, wherefore it never occurs that the admixture remains in the stirring space 3*a*. Accordingly, the resin kneaded product can be dispersed evenly in the entire admixture housed in the vessel 2. This makes it possible to suppress the widening of the particle size distribution of the colorant-containing resin particles, and thereby obtain a toner free from, for example, uneven charging capability that is thus suitable for use as an electrostatic charge image developing toner.

Moreover, although, in this embodiment, the blade member 8 of the rotor 5 is so designed that its one circumferential direction-wise surface is made as a curved surface and the angle that the curved surface forms with the axis of rotation 6 becomes larger gradually from the base end 8*a* fixed to the rotary shaft member 7 to the free end 8*b*, the configuration of the blade member 8 is not limited thereto. For example, the blade member 8 may be so designed that its one circumferential direction-wise surface is made as a flat surface, and the angle which the flat surface forms with the axis of rotation 6 is kept constant from the base end 8*a* fixed to the rotary shaft member 7 to the free end 8*b*. However, it is desirable to use the rotor 5 having the blade member 8 whose one circumferential direction-wise surface is made as a curved surface, as practiced in this embodiment. This is because, as compared with the rotor having the blade member whose one circumferential direction-wise surface is made as a flat surface, the rotor 5 having the blade member 8 whose one circumferential direction-wise surface is made as a curved surface is able to push the kneaded product out in the vertical direction from top to bottom more strongly, and thus impart a greater shear force to the kneaded product. That is, the use of the rotor 5 of this type helps facilitate the granulation of the kneaded product even further.

Moreover, in this embodiment, the admixture discharge hole 9 is formed in the shape of a slit. Although the shape of the admixture discharge hole 9 is not limited to the slit but may be of another shape such as a circle or a square, it is desirable to adopt the slit-like shape as practiced in the embodiment. This is because the resin kneaded product can be pulverized into ever smaller particles through the slit-shaped admixture discharge hole 9, wherefore such toner particles as have a smaller volumetric average particle diameter ranging, for example, from 3 μm to 8 μm can be formed with ease. As another advantage, since the admixture can be discharged from the stirring space 3*a* with stability, it is possible to achieve the granulation of the resin kneaded product more efficiently.

Further, although, in this embodiment, the admixture is stirred while rotating the screen 4, the screen 4 does not necessarily have to be rotated. However, it is desirable to, as is the case with the embodiment, stir the admixture with the screen 4 kept in a rotating state. This makes it possible to impart a greater shear force to the resin kneaded product and thereby facilitate the granulation of the resin kneaded product even further.

As described heretofore, the admixture composed of the resin kneaded product and the dispersant-containing aqueous medium is heated and stirred to granulate the resin kneaded product, whereupon, as toner particles, colorant-containing resin particles can be formed in the admixture. After that, the procedure proceeds to Step s4.

[Cooling Step]

In the cooling step at Step s4, the admixture containing the colorant-containing resin particles thus formed (hereafter also referred to as "the water base slurry") is cooled. Following the completion of formation of the colorant-containing resin particles in the granulation step at Step s3, the heating operation is stopped to cool the water base slurry. At this time, preferably, the water base slurry is cooled forcibly by using a coolant, or is left to cool by itself. For example, by providing a cooling section for cooling the admixture housed in the vessel 2 of the stirring apparatus 1 shown in FIG. 2, it is possible to effect the cooling step subsequent to the granulation step.

In the granulation step, of the admixture composed of the resin kneaded product and the dispersant-containing aqueous medium, the dispersant-containing aqueous medium receives application of heat to bring the resin kneaded product into a molten state in preparation for granulation. Therefore, just-formed colorant-containing resin particles are in a molten state and thus exhibit viscosity. In this state, the colorant-containing resin particles are prone to adhere to each other to eventually form oversized particles. In this regard, in this embodiment, since the admixture contains, in addition to the colorant-containing resin particles, the dispersant to stabilize the colorant-containing resin particles, it follows that the colorant-containing resin particles can be dispersed evenly in the dispersant-containing aqueous medium. Accordingly, in the cooling step, formation of oversized colorant-containing resin particles will never take place, and thus the colorant-containing resin particles can be cooled in the state of being dispersed evenly in the dispersant-containing aqueous medium, with the shape and the size thereof remained intact. This makes it possible to produce toner particles that have a small volumetric average particle diameter ranging, for example, from 3 μm to 8 μm, exhibit narrow particle size distribution, and are made uniform in shape and size.

It is preferable that the admixture (the water base slurry) is cooled with stirring. If the admixture is cooled without stirring, in a case where the temperature of the dispersant-containing aqueous medium is equal to or higher than the softening temperature Tm of the resin kneaded product, it becomes impossible to take advantage of the stable dispersive effect produced by the dispersant, and thus the colorant-containing resin particles may become fused to each other. Hence, it is desirable to continue stirring for the admixture (the water base slurry) also in the cooling step.

Moreover, in a case where the granulation of the resin kneaded product is conducted under pressure with the temperature at which the dispersant-containing aqueous medium is heated set at or above 100° C., it is desirable to continue the pressurization also in the subsequent cooling step. If, in the case of setting the temperature of the dispersant-containing aqueous medium at or above 100° C., the pressurization is stopped to return the pressure in the vessel 2 to atmospheric pressure, the water base slurry will be boiled to eventually produce a large number of air bubbles, which makes the subsequent procedures difficult. The pressure in the vessel 2 is adjusted to return to atmospheric pressure preferably at the instant when the temperature of the admixture housed in the vessel 2 reaches 50° C. or below, and more preferably after the admixture housed in the vessel 2 is cooled to room temperature (ca. 25° C.).

[Separation Step]

In the separation step at Step s5, the colorant-containing resin particles are separated and collected from the dispersant-containing aqueous medium having undergone cooling. The separation of the colorant-containing resin particles from the dispersant-containing aqueous medium can be effected in accordance with publicly known methods, for example, filtration, filtration under suction, and centrifugal separation.

[Cleaning Step]

In the cleaning step at Step s6, the colorant-containing resin particles separated from the dispersant-containing aqueous medium are subjected to cleaning to remove the dispersant, impurities derived from the dispersant, and other unnecessary substances. If the dispersant and such impurities remain in the toner particles, the charging capability of the resultant toner particles may become unstable. Furthermore, there may occur deterioration in chargeability under the influence of water content in the air.

For example, the cleaning for the colorant-containing resin particles can be effected by means of water washing. It is preferable that the water washing for the colorant-containing resin particles is carried out repeatedly until the electrical conductivity of cleaning water already used to clean the colorant-containing resin particles is lowered to 100 μS/cm or below (preferably 10 μS/cm or below) by using a conductivity meter or the like apparatus. This makes it possible to avoid occurrence of a residue of the dispersant and impurities more reliably, and thereby make the charging amount of the toner particles uniform even further.

For the water washing, it is desirable to use water having electrical conductivity of 20 μS/cm or below. Such water can be prepared by means of, for example, an activated carbon method, an ion exchanging method, a distillation method, or a reverse osmosis method. Note that two or more of these methods may be used in combination for the preparation of water. The water washing for the colorant-containing resin particles may be carried out in either a batch-wise manner or a continuous manner. Although the temperature of the cleaning water is not particularly restricted, preferably it is set to fall in a range of from 10° C. to 80° C.

Note that the cleaning step at Step s6 may precede the separation step at Step s5. In this case, for example, the cleaning for the colorant-containing resin particles can be effected by washing with water the colorant-containing resin particles contained in the admixture having undergone cooling. It is preferable that the water washing for the colorant-containing resin particles is carried out repeatedly until the electrical conductivity of supernatant fluid separated by means of centrifugal separation or otherwise from the admixture is lowered to 100 μS/cm or below (preferably 10 μS/cm or below) by using a conductivity meter or the like apparatus. This makes it possible to avoid occurrence of a residue of the dispersant and impurities more reliably, and thereby make the charging amount of the toner particles uniform even further.

[Drying Step]

In the drying step at Step s7, the colorant-containing resin particles having undergone cleaning are dried. Drying for the colorant-containing resin particles, namely toner particles can be effected in accordance with a publicly known method such as a freeze drying method or a flash drying method.

While the toner particles thus obtained can be used as they are as a toner, they may be subjected to surface modification using an external additive agent such as a surface reforming agent. As the surface reforming agent, particles of metallic oxides such as silica and titanium oxide can be used. It is also possible to use an agent obtained by performing a surface reforming treatment such as a hydrophobic treatment on the surface reforming agent as mentioned above by using, for example, a silane coupling agent. Although the proportion of the external additive agent to be used to the toner particles is not particularly restricted, preferably it is set to fall in a range of from 0.1 to 10 parts by weight with respect to 100 parts by weight of the toner particles, and more preferably from 1 to 5 parts by weight.

In the manner described thus far, there can be obtained a toner composed of constituents including toner particles or toner particles with an external additive agent added thereto. Following the completion of the toner formation, the procedure proceeds from Step s7 to Step s8, whereupon the toner production according to the embodiment comes to an end. By adopting the toner manufacturing method of the embodiment for toner production, it is possible to produce such a toner as has a small volumetric average particle diameter ranging, for example, from 3 μm to 8 μm with narrow particle size distribution without the necessity of classification.

For example, the toner obtained by the toner manufacturing method of the invention can be used for development of electrostatic charge images during the course of image formation conducted by means of electrophotography, electrostatic recording, or otherwise, as well as development of magnetic latent images during the course of image formation conducted by means of magnetic recording or otherwise. Note that, because of its exhibiting a narrow particle size distribution and being free from uneven charging capability, the toner obtained by the toner manufacturing method of the invention is especially advantageous if it is used as an electrostatic charge image developing toner for use in electrostatic charge image development. The use of the toner obtained by the manufacturing method of the invention enables formation of high-quality images free from imperfections resulting from variation in the charging amount of toner, a decrease in image density, white background fogging, or the like problem. The toner obtained by the manufacturing method of the invention can be used either as a single-component type developer or a dual-component type developer.

EXAMPLES

Hereinafter, the invention will be described more in detail with reference to Examples and Comparative examples, however it is not intended that the invention be limited to the illustrated examples.

[Preparation of Water]

In any of Examples and Comparative examples described hereinbelow, ion-exchanged water having electrical conductivity of 1 μS/cm was used for preparation of the dispersant-containing aqueous medium and for cleaning of the colorant-containing resin particles (toner particles). The ion-exchanged water was prepared from tap water by a pure water manufacturing apparatus: MINIPURE TW-300 RU (trade name) manufactured by Nomura Micro Science Co., Ltd. The electrical conductivity of the ion-exchanged water was measured by using a LACOM TESTER EC-PHCON 10 (trade name) manufactured by Iuchi Seieido Corporation.

[Peak Top Molecular Weight and Molecular Weight Distribution Index (Mw/Mn) of Binder Resin]

The peak top molecular weight and the molecular weight distribution index (Mw/Mn) of the binder resin were measured as follows. With use of a GPC apparatus: HLC-8220 GPC (trade name) manufactured by Tosoh Corporation, a molecular weight distribution curve was obtained under conditions of measurement temperature of 40° C., sample solution of 0.25% solution, by weight, of tetrahydrofuran, and the amount of injection of sample solution of 100 mL. The molecular weight at the vertex of the peak of the obtained molecular weight distribution curve was defined as the peak top molecular weight. Moreover, on the basis of the obtained molecular weight distribution curve, a weight average molecular weight Mw and a number average molecular weight Mn were derived, and the ratio of the weight average molecular weight Mw to the number average molecular weight Mn, namely, the molecular weight distribution index Mw/Mn (hereafter also referred to simply as "(Mw/Mn)") was obtained. Note that a molecular weight calibration curve was formed by using standard polystyrene.

[Softening Temperature of Binder Resin and Resin Kneaded Product]

The softening temperatures of the binder resin and the resin kneaded product were measured as follows. With use of a rheological characteristics evaluation apparatus: FLOW TESTER CFT-500C (trade name) manufactured by Shimadzu Corporation, a sample of 1 g was inserted into a cylinder, and a load of 10 kgf/cm$^2$ (980 kPa) was applied to extrude the sample from a die while heating the sample at a temperature elevation rate of 6° C./min. Then, a temperature at which half of the sample flowed out of the die was defined as the softening temperature. Note that the die in use is 1 mm in diameter and 1 mm in length.

[Glass Transition Temperature (Tg) of Binder Resin]

The glass transition temperature (Tg) of the binder resin was measured as follows. With use of a differential scanning calorimeter: DSC 220 (trade name) manufactured by Seiko Instruments Inc., and in conformity with Japan Industrial Standards (JIS) K7121-1987, a sample of 1 g was heated at a temperature elevation rate of 10° C./min to obtain a DSC curve. On the basis of the DSC curve, there was obtained a temperature at the point of intersection between the base line extending straightly from the high temperature side to the low temperature side with respect to the endothermic peak of the DSC curve corresponding to glass transition and the tangential line drawn at a point where the slope of the curve from the starting part of the peak to the vertex of the peak is at the maximum. This temperature was defined as the glass transition temperature (Tg).

[Acid Value of Binder Resin]

The acid value of the binder resin was measured as follows in accordance with a neutralization titrimetric method. A sample of 5 g was dissolved in 50 mL of a solvent of a mixture in which the ratio of xylene to dimethyl formamide is 1 to 1 (ratio by weight), and a few droplets of a phenolphthalein-base ethanol solution were added thereto as an indicator. After that, titration was performed by using 0.1 mol/L of a potassium hydrate (KOH) aqueous solution. At this time, a point in which the color of the sample solution has been changed from colorlessness to purple was defined as an end point. Then, the acid value (mgKOH/g) was determined by calculation of the amount of the potassium hydrate aqueous solution taken until the end point has been reached and the weight of the sample used for titration.

[Tetrahydrofuran-Insoluble Component of Binder Resin]

The content of a component which is insoluble in tetrahydrofuran (THF for shirt) in the binder resin was measured as follows. A sample of 1 g put in a filter paper thimble was placed in a Soxhlet extractor. With use of 100 mL of tetrahydrofuran as a solvent, the sample has been refluxed under heating for 6 hours to extract a component which is soluble in THF in the sample (hereafter referred to as "the THF-soluble component"). Then, the solvent was removed from the extraction liquid containing the THF-soluble component thus taken, and the THF-soluble component has been dried at a temperature of 100° C. for 24 hours. After that, the weight W (g) of the obtained THF-soluble component was weighed. On the basis of the weight W (g) of the THF-soluble component and the weight (1 g) of the sample used for the measurement, a proportion P (% by weight) of a component which is insoluble in THF contained in the binder resin, namely a THF-insoluble component of the binder resin was determined by calculation according to the following formula (1). Note that the proportion P will hereafter be referred to as "the THF-insoluble component".

$$P(\%\text{ by weight})=(1(g)-W(g))/1(g)\times 100 \quad (1)$$

[Loss Elastic Modulus G" of Resin Kneaded Product]

The loss elastic modulus G" of the resin kneaded product was measured as follows by using a viscoelasticity measurement apparatus: RHEOPOLYMER (trade name) manufactured by REOLOGICA Instruments AB and parallel plates. At first a sample held by the parallel plates was melted at a temperature of 150° C. Then, under conditions of parallel plate interval of 1.0 mm, strain of 0.5, and frequency of 1 Hz, the sample was subjected to temperature elevation from 60° C. to 200° C. at a temperature elevation rate of 3° C./min to measure the loss elastic modulus G" at each temperature individually, with the temperature interval for measurement set at 0.5° C. In this way, there was obtained the loss elastic modulus G" at the subsequently-described granulation temperature.

[Volumetric Average Particle Diameter and Variable Coefficient]

The volumetric average particle diameter ($D_{50}$) and the variable coefficient (CV) of the colorant-containing resin particles (toner particles) were measured by using a particle size distribution measurement apparatus: COULTER MULTISIZER II (trade name) manufactured by Coulter Inc. The number of particles to be measured was set at 50000 counts and the aperture diameter was set at 100 μm. Note that, the smaller is the value of the variable coefficient, the narrower is the particle size distribution.

Example 1

Kneading Step

There were prepared: 890 parts of polyester resin A (having glass transition temperature of 56.7° C., peak top molecular weight of 12500, Mw/Mn of 2.5, acid value of 16, softening temperature of 102° C., and THF-insoluble component of 0%) for use as a binder resin; 50 parts of C.I. pigment blue 15:3 BLUE NO. 26 (trade name) manufactured by Dainichi seika Color & Chemicals Mfg. Co., Ltd. for use as a colorant; 10 parts of a charge controlling agent: BONTRON E 84 (trade name) manufactured by Orient Chemical Industries, Ltd.; and 50 parts of wax: TOWAX 161 (trade name) manufactured by To a Kasei Co., Ltd. for use as a release agent. These constituent components have been mixed and dispersed for 3 minutes by using a mixer: HENSCHEL MIXER (trade name) manufactured by Mitsui Mining Co., Ltd. to obtain a raw material admixture. Next, the obtained raw material admixture was melt-kneaded by using a twin-screw extruder: PCM-30 (trade name) manufactured by Ikegai Co., Ltd. under operating conditions of cylinder setting temperature of 110° C., barrel rotational speed of 300 rotations/min. (300 rpm), and raw material admixture feeding speed of 20 kg/h to prepare a resin kneaded product A. It has been found that the resin kneaded product A thus obtained has a softening temperature of 105° C., and exhibits a loss elastic modulus G" of $1.5\times10^4$ Pa at a temperature of 120° C. which corresponds to a predetermined granulation temperature in the subsequently-described granulation step.

[Aqueous Medium Preparation Step]

A dispersant-containing aqueous medium was prepared by blending and dissolving a dispersant in ion-exchanged water (electrical conductivity of 1 μS/cm) in a manner so as to insure that the solid matter concentration of the dispersant stands at 10% by weight. As the dispersant, a water-soluble polymeric compound, namely, styrene-α-methylstyrene-acrylic acid copolymer ammonium salt: JONCRYL 61 J (trade name) manufactured by Johnson Polymer Corporation (having weight average molecular weight of 13000 and number average molecular weight of 3700) was used. The weight average molecular weight and the number average molecular weight of the dispersant were measured in the same manner as in the case of the binder resin.

[Granulation Step]

At first, 200 parts of the resin kneaded product A and 900 parts of the dispersant-containing aqueous medium (having dispersant concentration of 10% by weight) were blended together. The resultant admixture was charged into the vessel 2 of the stirring apparatus: CLEAR MIX (trade name) manufactured by M Technique Co., Ltd. corresponding to the above stated stirring apparatus 1 shown in FIG. 2. Then, the admixture was heated with stirring until the temperature of the thermometer 14 disposed in the vessel 2 has reached 120° C., namely the granulation temperature as listed in Table 1, under conditions of the number of rotation of the rotor 5 of 5000 rpm (5000 rotations/min.) and the number of rotation of the screen 4 of 4500 rpm (4500 rotations/min.). At that point in time when the temperature of the thermometer 14 reached 120° C., the number of rotation of the rotor 5 was increased to 15000 rpm (15000 rotations/min.) and also the number of rotation of the screen 4 was increased to 13500 rpm (13500 rotations/min.) (the ratio of the rpm of the screen 4 to the rpm of the rotor 5 is 0.90). After that, stirring has been further carried out for 10 minutes, with the temperature of the thermometer 14 kept at 120° C., to disperse the resin kneaded product A in the dispersant-containing aqueous medium, whereupon a water dispersion of colorant-containing resin particles was prepared. Note that, in Example 1, the rotor 5 in use has a blade member whose maximum outer diameter of 35 mm. Therefore, the blade member exhibits a circumferential velocity of 27.5 m/s when the number of rotation of the rotor 5 is set at 15000 rpm. Moreover, as has already been described with reference to FIG. 3, the screen 4 and the rotor 5 were rotated in opposite directions.

[Cooling Step]

Following the completion of the granulation step described just above, the heater 13 was deactivated to bring the heating operation to a halt. Then, the water dispersion has been cooled to a temperature of 30° C. with stirring. In the cooling step, the number of rotation of the rotor 5 was set at 8000 rpm (8000 rotations/min.) and the number of rotation of the screen 4 was set at 7200 rpm (7200 rotations/min.).

[Separation Step, Cleaning Step, and Drying Step]

The cooled water dispersion of colorant-containing resin particles was filtered off to sort out the colorant-containing resin particles. The sorted, water-containing matter obtained by filtration was then added with ion-exchanged water (electrical conductivity=1 μS/cm) having a temperature of 25° C., and the resultant solution was subjected to dispersion and filtration again. The operation was carried out twice until the electrical conductivity of the cleaning water has reached 10 PS/cm or below after cleaning for the colorant-containing resin particles. In this way, the colorant-containing resin particles were washed. The colorant-containing resin particles having undergone cleaning were freeze-dried, whereupon there were obtained toner particles having a volumetric average particle diameter ($D_{50}$) of 5.3 μm and a variable coefficient (CV) of 25.

Example 2

As Example 2, a toner having a volumetric average particle diameter ($D_{50}$) of 6.1 μm and a variable coefficient (CV) of 26 was formed by carrying out the same operations as those in Example 1 except that, in the granulation step, after the granulation temperature has been reached, the number of rotation of the rotor 5 was adjusted to 12000 rpm (12000 rotations/min.) and the number of rotation of the screen 4 was adjusted to 10800 rpm (10800 rotations/min.) (the ratio of the rpm of the screen 4 to the rpm of the rotor 5 stood at 0.90).

Example 3

As Example 3, a toner having a volumetric average particle diameter ($D_{50}$) of 4.3 μm and a variable coefficient (CV) of 22 was formed by carrying out the same operations as those in Example 1 except that, in the granulation step, after the granulation temperature has been reached, the number of rotation of the rotor 5 was adjusted to 20000 rpm (20000 rotations/min.) and the number of rotation of the screen 4 was adjusted to 18000 rpm (18000 rotations/min.) (the ratio of the rpm of the screen 4 to the rpm of the rotor 5 is 0.90).

Example 4

As Example 4, a toner having a volumetric average particle diameter ($D_{50}$) of 10.2 μm and a variable coefficient (CV) of 31 was formed by carrying out the same operations as those in Example 1 except that, in the granulation step, after the granulation temperature has been reached, the number of rotation of the screen 4 was adjusted to 7500 rpm (7500 rotations/min.) (the ratio of the rpm of the screen 4 to the rpm of the rotor 5 is 0.50).

Example 5

As Example 5, a toner having a volumetric average particle diameter ($D_{50}$) of 5.1 μm and a variable coefficient (CV) of 23 was formed by carrying out the same operations as those in Example 1 except that, in the granulation step, after the granulation temperature has been reached, the number of rotation of the screen 4 was adjusted to 14200 rpm (14200 rotations/min.) (the ratio of the rpm of the screen 4 to the rpm of the rotor 5 is 0.95).

Example 6

As Example 6, a toner having a volumetric average particle diameter ($D_{50}$) of 12.3 μm and a variable coefficient (CV) of 32 was formed by carrying out the same operations as those in Example 1 except that, in the granulation step, the granulation temperature was set at 85° C.

Example 7

As Example 7, a toner having a volumetric average particle diameter ($D_{50}$) of 7.1 μm and a variable coefficient (CV) of 25 was formed by carrying out the same operations as those in Example 1 except that, in the granulation step, the granulation temperature was set at 105° C.

Example 8

As Example 8, a toner having a volumetric average particle diameter ($D_{50}$) of 22.4 μm and a variable coefficient (CV) of 50 was formed by carrying out the same operations as those in Example 1 except that, in the granulation step, the screen 4 has been kept in a non-rotated state.

Example 9

As Example 9, a toner having a volumetric average particle diameter ($D_{50}$) of 18.3 μm and a variable coefficient (CV) of 45 was formed by carrying out the same operations as those in Example 1 except that, in the granulation step, after the granulation temperature has been reached, the number of rotation of the screen 4 was adjusted to 6000 rpm (6000 rotations/min.) (the ratio of the rpm of the screen 4 to the rpm of the rotor 5 is 0.40).

Comparative Example 1

As Comparative example 1, a toner having a volumetric average particle diameter ($D_{50}$) of 25.2 μm and a variable coefficient (CV) of 55 was formed by carrying out the same operations as those in Example 1 except that, in the granulation step, instead of the stirring apparatus 1 realized by the use of CLEAR MIX (trade name) manufactured by M Technique Co., Ltd., an stirring apparatus constructed by removing the screen 4 from the stirring apparatus 1 was used, and, for granulation, the number of rotation of the rotor was maintained at 3000 rpm (3000 rotations/min.) until the granulation temperature has been reached, and was increased to 12000 rpm (12000 rotations/min.) at the instant of reaching the granulation temperature.

Reference Example 1

In order to form a toner, the same operations as those in Example 1 were carried out, with the exception, however, that, in the granulation step, after the granulation temperature has been reached, the number of rotation of the rotor 5 was adjusted to 2000 rpm (2000 rotations/min.) and the number of rotation of the screen 4 was adjusted to 1800 rpm (180° rotations/min.) (the ratio of the rpm of the screen 4 to the rpm of the rotor 5 is 0.90). However, this attempt failed to obtain colorant-containing resin particles.

Reference Example 2

Likewise, the same operations as those in Example 1 were carried out, with the exception, however, that the granulation temperature was set at 80° C. in the granulation step. However, this attempt failed to obtain colorant-containing resin particles.

Reference Example 3

In order to form a toner, at first, a resin kneaded product B was formed in the same manner as in the kneading step for Example 1, except that, as a binder resin, polyester resin B (having glass transition temperature of 53.0° C., peak top molecular weight of 5940, Mw/Mn of 14.5, acid value of 7.7, softening temperature of 115° C., and THF-insoluble component of 0%) was used. It has been found that the resin kneaded product B thus obtained has a softening temperature of 135° C., and exhibits a loss elastic modulus G" of $1.2\times10^5$ Pa at a temperature of 120° C., which corresponds to the granulation temperature in the granulation step. In regard to the subsequent granulation step, the same operations as those in Example 1 were carried out. However, this attempt failed to obtain colorant-containing resin particles.

Reference Example 4

Likewise, at first, a resin kneaded product C was formed in the same manner as in the kneading step for Example 1, except that, as a binder resin, polyester resin C (having glass transition temperature of 58.6° C., peak top molecular weight of 13500, Mw/Mn of 4.4, acid value of 6.0, softening temperature of 114° C., and THF-insoluble component of 0%) was used. It has been found that the resin kneaded product C thus obtained has a softening temperature of 146° C., and exhibits a loss elastic modulus G" of $2.2\times10^5$ Pa at a temperature of 120° C., which corresponds to the granulation temperature in the granulation step. In regard to the subsequent granulation step, the same operations as those in Example 1 were carried out. However, this attempt failed to obtain colorant-containing resin particles.

Reference Example 5

In order to form a toner, the same operations as those in Example 1 were carried out, with the exception, however, that, in the aqueous medium preparation step, a water-insoluble inorganic dispersant was used as the dispersant instead of styrene-α-methylstyrene-acrylic acid copolymer ammonium salt. As the water-insoluble inorganic dispersant, calcium carbonate: LUMINUS (trade name) manufactured by Maruo Calcium Co., Ltd. was used. However, this attempt failed to obtain colorant-containing resin particles.

Listed in Table 1 are the volumetric average particle diameters $D_{50}$ (μm) and the variable coefficients (CV) of the toners implemented by way of Examples and Comparative examples. Note that the number of rotation of the rotor and the same of the screen listed in Table 1 are the values counted after the granulation temperature has been reached. Also listed in Table 1 are the circumferential velocity of the rotor 5.

TABLE 1

| | Resin kneaded product | | | |
|---|---|---|---|---|
| | Kind | Loss elastic modulus (Pa) | Softening temperature Tm (° C.) | Dispersant |
| Example 1 | A | $1.5\times10^4$ | 105 | Styrene-α-methylstyrene-acrylic acid copolymer ammonium salt |
| Example 2 | A | $1.5\times10^4$ | 105 | Styrene-α-methylstyrene-acrylic acid copolymer ammonium salt |
| Example 3 | A | $1.5\times10^4$ | 105 | Styrene-α-methylstyrene-acrylic acid copolymer ammonium salt |
| Example 4 | A | $1.5\times10^4$ | 105 | Styrene-α-methylstyrene-acrylic acid copolymer ammonium salt |
| Example 5 | A | $1.5\times10^4$ | 105 | Styrene-α-methylstyrene-acrylic acid copolymer ammonium salt |
| Example 6 | A | $1.5\times10^4$ | 105 | Styrene-α-methylstyrene-acrylic acid copolymer ammonium salt |
| Example 7 | A | $1.5\times10^4$ | 105 | Styrene-α-methylstyrene-acrylic acid copolymer ammonium salt |
| Example 8 | A | $1.5\times10^4$ | 105 | Styrene-α-methylstyrene-acrylic acid copolymer ammonium salt |
| Example 9 | A | $1.5\times10^4$ | 105 | Styrene-α-methylstyrene-acrylic acid copolymer ammonium salt |
| Comp. Example | A | $1.5\times10^4$ | 105 | Styrene-α-methylstyrene-acrylic acid copolymer ammonium salt |
| Ref. Example 1 | A | $1.5\times10^4$ | 105 | Styrene-α-methylstyrene-acrylic acid copolymer ammonium salt |
| Ref. Example 2 | A | $1.5\times10^4$ | 105 | Styrene-α-methylstyrene-acrylic acid copolymer ammonium salt |
| Ref. Example 3 | B | $1.2\times10^5$ | 135 | Styrene-α-methylstyrene-acrylic acid copolymer ammonium salt |
| Ref. Example 4 | C | $2.2\times10^5$ | 146 | Styrene-α-methylstyrene-acrylic acid copolymer ammonium salt |
| Ref. Example 5 | A | $1.5\times10^4$ | 105 | Inorganic Dispersant |

| | Granulation temperature (° C.) | Number of rotation of rotor (rpm) | Circumferential velocity of rotor (m/s) | Number of rotation of screen (rpm) |
|---|---|---|---|---|
| Example 1 | 120 | 15000 | 27.5 | 13500 |
| Example 2 | 120 | 12000 | 22.0 | 10800 |
| Example 3 | 120 | 20000 | 36.7 | 18000 |
| Example 4 | 120 | 15000 | 27.5 | 7500 |
| Example 5 | 120 | 15000 | 27.5 | 14200 |
| Example 6 | 85 | 15000 | 27.5 | 13500 |
| Example 7 | 105 | 15000 | 27.5 | 13500 |

TABLE 1-continued

| | | | | |
|---|---|---|---|---|
| Example 8 | 120 | 15000 | 27.5 | 0 |
| Example 9 | 120 | 15000 | 27.5 | 6000 |
| Comp. Example | 120 | 12000 | 22.0 | — |
| Ref. Example 1 | 120 | 2000 | 3.7 | 1800 |
| Ref. Example 2 | 80 | 16000 | 27.5 | 13500 |
| Ref. Example 3 | 120 | 15000 | 27.5 | 13500 |
| Ref. Example 4 | 120 | 15000 | 27.5 | 13500 |
| Ref. Example 5 | 120 | 15000 | 27.5 | 13500 |

| | Rpm ratio (screen/rotor) | Volumetric average particle diameter $D_{50}$ (μm) | Variable coefficient CV | Remarks |
|---|---|---|---|---|
| Example 1 | 0.90 | 5.3 | 25 | |
| Example 2 | 0.90 | 6.1 | 26 | |
| Example 3 | 0.90 | 4.3 | 22 | |
| Example 4 | 0.50 | 10.2 | 31 | |
| Example 5 | 0.95 | 5.1 | 23 | |
| Example 6 | 0.90 | 12.3 | 32 | |
| Example 7 | 0.90 | 7.1 | 25 | |
| Example 8 | — | 22.4 | 50 | |
| Example 9 | 0.40 | 18.3 | 45 | |
| Comp. Example | — | 25.2 | 55 | Without screen |
| Ref. Example 1 | 0.90 | — | — | Granulation failed |
| Ref. Example 2 | 0.90 | — | — | Granulation failed |
| Ref. Example 3 | 0.90 | — | — | Granulation failed |
| Ref. Example 4 | 0.90 | — | — | Granulation failed |
| Ref. Example 5 | 0.90 | — | — | Granulation failed |

As will be understood from Table 1, by using such an stirring apparatus as has a rotor and a screen and also by properly selecting the operating conditions of the stirring apparatus, as practiced according to the invention, even if the granulation temperature is lower than the softening temperature of the resin kneaded product, it is possible to achieve granulation of the resin kneaded product successfully. Moreover, in contrast to the case where, like Comparative example 1, such an stirring apparatus as has no screen is used, the invention has succeeded in providing a toner of smaller volumetric average particle diameter and smaller variable coefficient.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner manufacturing method comprising:

a kneading step of kneading at least a binder resin and a colorant;

a granulation step of mixing a resin kneaded product obtained through the kneading step with an aqueous medium containing a dispersant and water, and heating the aqueous medium contained in an obtained admixture to a predetermined temperature while stirring the admixture so as to form resin particles containing the colorant within the aqueous medium; and a separation step of separating the formed resin particles containing the colorant from the aqueous medium, wherein, in the granulation step, the admixture is stirred by an stirring apparatus comprising a vessel for housing therein the admixture; an stirring space forming member for partitioning a space within the vessel into an stirring space in which the admixture is stirred and a space outside the stirring space, the stirring space forming member having an admixture discharge hole for providing communication between the stirring space and the space outside the stirring space; and an stirring section for stirring the admixture accommodated in the stirring space, wherein a loss elastic modulus G" of the resin kneaded product is kept at or below $10^5$ Pa at the temperature set for the aqueous medium in the granulation step.

2. A toner manufacturing method comprising:

a kneading step of kneading at least a binder resin and a colorant;

a granulation step of mixing a resin kneaded product obtained through the kneading step with an aqueous medium containing a dispersant and water, and heating the aqueous medium contained in an obtained admixture to a predetermined temperature while stirring the admixture so as to form resin particles containing the colorant within the aqueous medium; and a separation step of separating the formed resin particles containing the colorant from the aqueous medium, wherein, in the granulation step, the admixture is stirred by an stirring apparatus comprising a vessel for housing therein the admixture; an stirring space forming member for partitioning a space within the vessel into an stirring space in which the admixture is stirred and a space outside the stirring space, the stirring space forming member having an admixture discharge hole for providing communication between the stirring space and the space outside the stirring space; and an stirring section for stirring the admixture accommodated in the stirring space, wherein the stirring section includes a rotary shaft member which is rotatable about its axis of rotation, and a blade member which is formed on an outer peripheral surface of the rotary shaft member so as to extend radially outwardly of the rotary shaft member, wherein the stirring space forming member is rotated about the axis of rotation which is substantially in parallel with the axis of rotation of the rotary shaft member of the stirring section in a direction reverse to the direction in which the rotary shaft member is rotated, and wherein a ratio of the number of rotations of the stirring space forming member to the number of rotations of the rotary shaft member (the number of rotations of the stirring space forming member/the number of rotations of the rotary shaft member) falls in a range of from 0.50 to 0.95.

3. The toner manufacturing method of claim 1 or claim 2, wherein the admixture discharge hole of the stirring space forming member is formed in a shape of a slit.

4. The toner manufacturing method of claim 1, wherein the stirring section includes a rotary shaft member which is rotatable about its axis of rotation, and a blade member which is formed on an outer peripheral surface of the rotary shaft member so as to extend radially outwardly of the rotary shaft member.

5. The toner manufacturing method of claim 4 or claim 2, wherein rotational circumferential velocity of the blade member is greater than 3.7 m/s and equal to or less than 40 m/s.

6. The toner manufacturing method of claim 4, wherein the stirring space forming member is rotated about the axis of rotation which is substantially in parallel with the axis of rotation of the rotary shaft member of the stirring section in a direction reverse to the direction in which the rotary shaft member is rotated.

7. The toner manufacturing method of claim 1 or claim 2, wherein a temperature set for the aqueous medium in the granulation step stands at or above a value obtained by subtracting 20 (° C.) from the softening temperature Tm (° C.) of the resin kneaded product contained in the admixture (Tm−20 [° C.]).

8. The toner manufacturing method of claim 2, wherein a loss elastic modulus G" of the resin kneaded product is kept at or below $10^5$ Pa at the temperature set for the aqueous medium in the granulation step.

9. The toner manufacturing method of claim 1 or claim 2, wherein the dispersant for use is a substance soluble in water.

* * * * *